US007664439B2

(12) United States Patent
Sugiura

(10) Patent No.: US 7,664,439 B2
(45) Date of Patent: Feb. 16, 2010

(54) IMAGE FORMING APPARATUS, AND CARRIER, TONER AND DEVELOPER USED THEREIN FOR REDUCING FOGGY IMAGES

(75) Inventor: Hideki Sugiura, Shizuoka-Ken (JP)

(73) Assignee: Ricoh Company, Ltd., Tokyo (JP)

( * ) Notice: Subject to any disclaimer, the term of this patent is extended or adjusted under 35 U.S.C. 154(b) by 462 days.

(21) Appl. No.: 11/608,012

(22) Filed: Dec. 7, 2006

(65) Prior Publication Data

US 2007/0140748 A1 Jun. 21, 2007

(30) Foreign Application Priority Data

Dec. 8, 2005 (JP) ..... 2005-354322

(51) Int. Cl.
*G03G 15/09* (2006.01)

(52) U.S. Cl. ..... 399/267

(58) Field of Classification Search ..... 399/252, 399/254, 267, 270; 430/111.4, 110.1, 111.1
See application file for complete search history.

(56) References Cited

U.S. PATENT DOCUMENTS 6,503,676 B2 1/2003 Yamashita et al.
7,519,316 B2 * 4/2009 Sato ..... 399/254
2006/0024604 A1 2/2006 Sugiura et al.

FOREIGN PATENT DOCUMENTS

| | | |
|---|---|---|
| JP | 07-199519 | 8/1995 |
| JP | 2000-122336 | 4/2000 |
| JP | 2002-244314 | 8/2002 |
| JP | 2002-351129 | 12/2002 |

* cited by examiner

*Primary Examiner*—William J Royer
(74) *Attorney, Agent, or Firm*—Oblon, Spivak, McClelland, Maier & Neustadt, L.L.P.

(57) ABSTRACT

An image forming apparatus including an image bearer, a magnetic field generator, a two-component developer bearer, a developing electric field generator, and an image developer. The two-component developer has at least a current speed index (25FRI) of from 0 to 2.0, which is determined by the following formula: 25FRI=(total energy at 10 mm/s/total energy at 100 mm/s). The total energy is an integral sum of a rotary torque and a vertical load when a blade of a powder fluidity analyzer spirally rotates at 10 mm/s and 100 mm/s, respectively, in the developer having a volume of 25 ml after idly agitated in the image developer for 10 minutes.

20 Claims, 11 Drawing Sheets

IMAGE FORMING APPARATUS, AND CARRIER, TONER AND DEVELOPER USED THEREIN FOR REDUCING FOGGY IMAGES

BACKGROUND OF THE INVENTION

1. Field of the Invention

The present invention relates to an image forming apparatus, and a carrier, a toner and a developer used therein.

2. Discussion of the Background

Image forming methods such as electrophotography, electrostatic recording and electrostatic printing include, e.g., adhering a toner included in a developer to an image bearer such as a photoreceptor, on which a latent image is formed, to form a toner image thereon in a developing process; transferring the toner image onto a transfer medium such as a transfer paper in a transfer process; and fixing the toner image thereon in a fixing process. The developer includes a two-component developer including a magnetic carrier and a toner, and a one-component developer (magnetic or nonmagnetic toner) which does not need a carrier.

A dry toner prepared by the following method has conventionally been used. The method includes melting, kneading upon application of heat, cooling and hardening a toner binder such as a styrene resin and a polyester resin with a colorant, to prepare a cooled and hardened mixture; and pulverizing the cooled and hardened mixture. However, demands for higher-quality images are increasing recently, and particularly, toners are having smaller particle diameters and higher sphericity to realize production of high-definition color images. Toners having smaller particle diameters have better dot reproducibility, and toners having higher sphericity improve their developability and transferability.

The toner formed of a resin has a volume-average particle diameter of about 10 μm, and an inorganic/organic particulate material is externally added thereto to give fluidity thereto for covering the transportability and mixability thereof. Inorganic particulate materials such as silica, alumina and titanium oxide are typically attached to a toner by dry mixing and stirring them with the toner with a mixer.

However, the inorganic particulate material externally added to a toner is soon buried therein by a stress with a member (of an apparatus) contacting thereto, resulting in deterioration of fluidity, feedability, developability and chargeability thereof. In addition, the inorganic particulate material not fully mixed therewith is released therefrom and floats in the apparatus to contaminate the apparatus, and further adheres to an image bearer such as a photoreceptor in the apparatus and becomes a base that toner fixes to, resulting in filming of the toner.

Recently, a number of methods granulating toner particles in a liquid, such as a suspension polymerization method, an emulsification polymerization method and a dispersion polymerization method, have been developed to make a toner have smaller particle diameter and more sphericity. However, a spherical toner easily rolls on an image bearer and passes through a cleaning blade formed of an elastomer, resulting in poor cleaning.

Japanese Laid-Open Patent Publications Nos. 2002-244314 and 2002-351129 disclose a toner including an additive, the release rate of which is determined by a particle analyzer. However, the particle analyzer does not have enough detection sensitivity to detect a slight difference between the adherence amount and release amount of the additive. In addition, the particle analyzer is not capable of designing a suitable control range of an additive having a low adherence rate of its parent particles, such as silica having a large particle diameter.

Japanese Patent No. 3129074 and Japanese Laid-Open Patent Publication No. 2000-122336 disclose a toner including an additive evaluated by an ultrasonic homogenizer. This has an effect on the chargeability of a toner and filming reduction thereof over a photoreceptor, but does not improve both the filming reduction and cleanability thereof.

One of the critical elements influencing a life span of a two-component developer using a magnetic carrier is adherence of toner constituents (i.e., spent toner constituents) to the carrier. Such toner constituents include a resin, a release agent (wax), a charge controlling agent and an external additive, which deteriorate chargeability of the developer when attached to the carrier. However, the influence that the severity, adherability and adherence status of each constituent has on the carrier are unknown.

When a toner receives a stress from, e.g., a developing screw in an image developer and loses fluidity, the toner and a carrier are not well mixed and the developer is not uniformly charged, thus resulting in production of foggy images. Particularly, in a low-temperature and low-humidity environment, when a developer increases its average charge quantity and the charge quantity between the charged toner and uncharged toner becomes large, the fluidity of the developer deteriorates, which is assumed to cause production of foggy images.

Because of these reasons, a need exists for an image forming apparatus capable of reliably producing high-quality images, using a long-life developer having much less spent toner and capable of reducing production of foggy images in a low-temperature and low-humidity environment.

SUMMARY OF THE INVENTION

Accordingly, an object of the present invention is to provide an image forming apparatus for reliably producing high-quality images, using a long-life developer having much less spent toner and capable of reducing production of foggy images in a low-temperature and low-humidity environment.

Another object of the present invention is to provide a carrier used therein.

A further object of the present invention is to provide a toner used therein.

Another object of the present invention is to provide a developer including the carrier and the toner.

These objects and other objects of the present invention, either individually or collectively, have been satisfied by the discovery of an image forming apparatus, comprising:

an image bearer configured to bear an electrostatic latent image on the surface;

a magnetic field generator configured to generate a magnetic field;

a developer bearer comprising a non-magnetic developing sleeve, configured to rotate and bear at least one two-component developer comprising a magnetic carrier and a toner;

a developing electric field generator configured to generate a developing electric field between the image bearer and the developer bearer; and an image developer configured to agitate the magnetic carrier and the toner to form two-component developer and develop the electrostatic latent image therewith in the developing electric field to form a toner image, wherein the two-component developer at least has a current speed index (25FRI) of from 0 to 2.0, which is determined by the following formula:

$$25FRI = (\text{total energy at 10 mm/s}/\text{total energy at 100 mm/s})$$

wherein the total energy is an integral sum of a rotary torque and a vertical load when a blade of a powder fluidity analyzer FT-4 from SYSMEX CORPORATION spirally rotates at 10 mm/s and 100 mm/s respectively in the developer having a volume of 25 ml after idly agitated in the image developer for 10 min.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
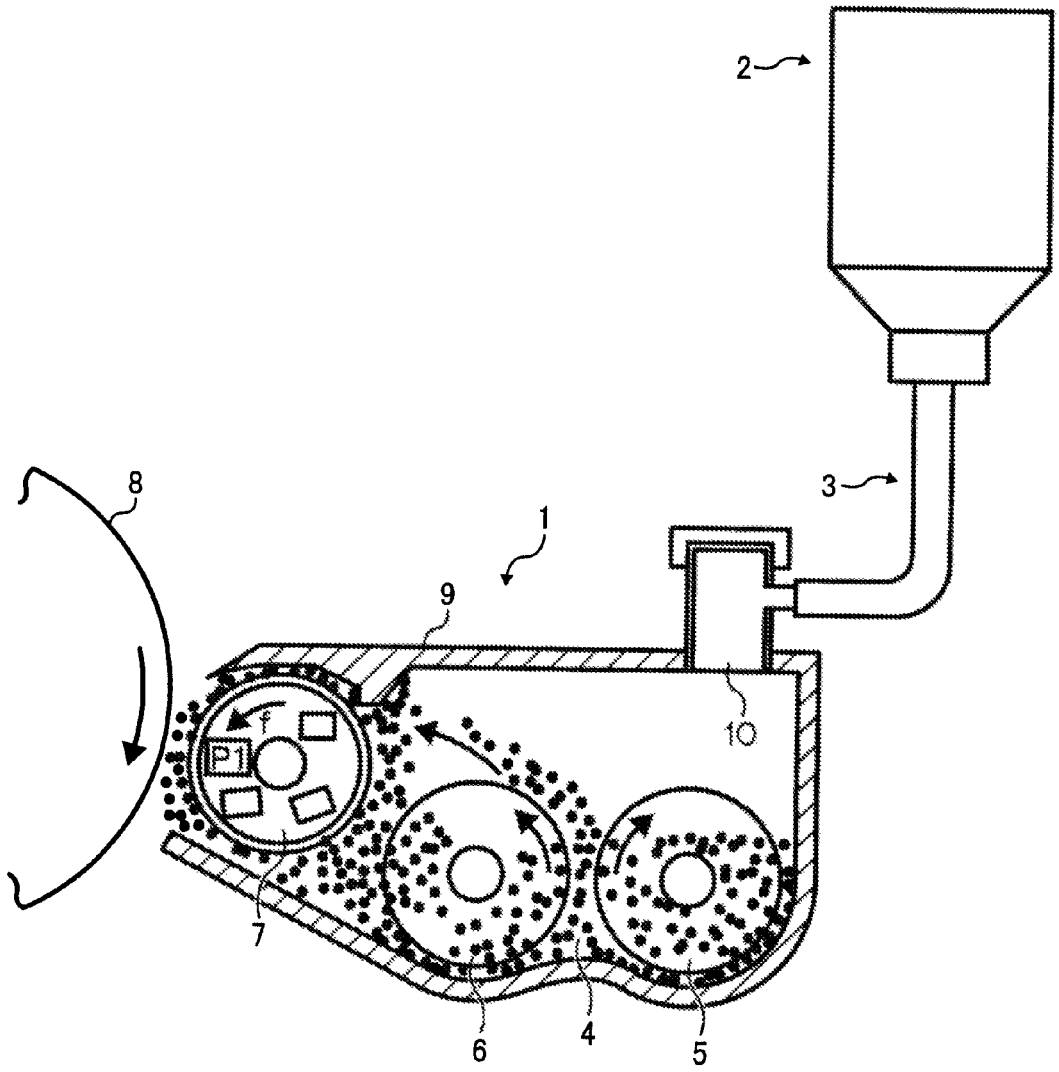
FIG. 1 is a schematic view illustrating an embodiment of an image developer in an image forming apparatus of the present invention.

The present invention provides an image forming apparatus for reliably producing high-quality images, using a long-life developer having much less spent toner and capable of reducing production of foggy images in a low-temperature and low-humidity environment.

The toner for use in the present invention includes at least a binder resin, a colorant and an external additive on the surface thereof.

In the present invention, an image forming apparatus, a carrier for a developer and a toner therefor fulfill their functions respectively to achieve the objects.

The image forming apparatus of the present invention includes an image bearer bearing an electrostatic latent image on the surface; a magnetic field generator generating a magnetic field; a developer bearer including a non-magnetic developing sleeve, rotating and bearing a two-component developer including a magnetic carrier and a toner; a developing electric field generator generating a developing electric field between the image bearer and the developer bearer; and an image developer developing the electrostatic latent image with the two-component developer in the developing electric field to form a toner image, wherein the developer has good agitatability, charge buildability and charge retainability, tends to give a stress to the developer. Namely, while a gap between the image bearer and the developing sleeve is adjusted to effectively charge the developer, an additive of the toner tends to be buried therein or released therefrom. In addition, a coating of the carrier tends to strip, the carrier-spend caused by toner constituents such as a resin, a wax, a charge controlling agent, a pigment, an external additive and an additive tends to occur, and filming thereof over a photoreceptor tends to occur. In order to improve foggy images (background fouling), toner scattering, hollow images, transfer dust (high transfer rate), the charge buildability and charge retainability of the developer are essential. Other measures for a carrier or a toner are needed to improve the spent toner, the release and burial of the additive, and the filming over a photoreceptor and poor cleaning thereof caused thereby.

The carrier needs to have a specific spent toner resistance. Among the external additives for a toner, controlling particularly an adherence amount of silica to a carrier is important because the silica has good coatability over the surface of a carrier. A toner in a two-component developer is friction-charged with the surface of a carrier, however, when the silica covers the surface of a carrier, the friction-charge site on the surface thereof decreases and the developer cannot keep good chargeability. Further, even when the surface of a carrier is not smooth, such as when the surface has a non-conductive particulate material thereon, silica having good coatability and adherence easily forms a film thereover. Even after that, the silica does not much release from a carrier, and when a toner includes a wax, the wax works as an adhesive which strengthens the adherence thereof and forms a firm anchoring of the silica therein.

In the above-mentioned specific image forming apparatus, as means of controlling the adherence of an additive to a carrier and fluidity of a developer, a particle diameter of the carrier, a coated resin, a filler (non-conductive particulate material) included and a particle diameter of the filler are particularly important. These have complementary relationships with each other, and which can consequently be consolidated to a combination of a specific carrier, a specific developer and a specific image forming apparatus, wherein a current speed index (25FRI) is from 0 to 2.0, and preferably from 1.2 to 2.0. In other words, 25FRI selects 1) a toner having high stress resistance, i.e., an external additive is difficult to bury therein or a toner keeping fluidity and chargeability even when the external additive is buried therein; 2) a carrier sufficiently charging a toner at a low stress, i.e., a carrier effectively charging a toner, contacting less thereto; 3) an image forming apparatus sufficiently charging a developer at a low stress, i.e., an image forming apparatus sufficiently charging a developer without unnecessarily agitating a carrier and a toner.

As a result of various investigations of the present inventor to lessen transportation of the external additive to a carrier, he discovered that the spent toner, filming over a photoreceptor and foggy images due to a deteriorated toner can dramatically be improved when the fluidity of a toner is precisely controlled in a specific narrow range. The fluidity of a toner, which is precisely controlled, not only decreases the spent toner and filming over a photoreceptor, but also causes a slight change of chargeability and charge distribution thereof, and which is assumed to decrease the foggy images due to a deteriorated toner.

A preferred embodiment of the image forming apparatus of the present invention includes a charger, an irradiator, an image developer, a transferer and a cleaner around a photoreceptor as an image bearer. In addition, a paper feeder feeding a transfer paper and a fixer fixing a toner image transferred onto the transfer paper thereon after leaving from the photoreceptor are included. In the image forming apparatus, after the surface of the photoreceptor rotating is uniformly charged by the charger, it is irradiated with a laser beam based on image information from the irradiator to form a latent image thereon. The image developer attaches a charged toner to the latent image to form a toner image. On the other hand, a transfer paper fed from the paper feeder is transported to a transfer site where the photoreceptor and the transferer face each other. The transferer charges the transfer paper to have a reverse polarity to that of the toner image such that the toner image is transferred onto the transfer paper. Then, the transfer paper is separated from the photoreceptor and fed to the fixer fixing the toner image thereon.

FIG. 1 is a schematic view illustrating an embodiment of an image developer 1 in the image forming apparatus of the present invention.

The image developer 1 is located laterally to a photoreceptor 8, and includes a non-magnetic developing sleeve 7 as a developer bearer bearing a two-component developer (hereinafter referred to as a "developer") including a toner and a magnetic carrier on its surface. The developing sleeve 7 is partially exposed from an opening formed toward the photoreceptor 8 in a developing casing, and rotated in the direction of an arrow f by a driver (not shown). Known materials, e.g., non-magnetic materials such as (coated) stainless steel, (coated) aluminum and (coated) ceramics are used for the developing sleeve 7, and are not particularly limited. The shape thereof is not particularly limited, either. The developing sleeve 7 includes a fixed magnet roller (not shown) formed of fixed magnets as a magnetic field generator. The image developer 1 also includes a doctor blade 9 formed of a rigid body as a developer regulator regulating an amount of the developer borne on the developing sleeve 7. In the upstream rotating direction of the developing sleeve 7 to the doctor blade 9, a developer container 4 containing the developer is located including first and second agitation screws 5 and 6 for agitating and mixing a developer therein. Above the developer container 4, a toner feeding port 10, a toner hopper 2 filled with the toner to be fed to the developer container 4 and a pipe 3 connecting the toner hopper 2 and the toner feeding port 10.

In the image developer 1, the first and second agitation screws 5 and 6 rotate to agitate the developer in the developer container 4, and the toner and the carrier are friction-charged to have a reverse polarity to each other. The developer is fed to and borne by the developing sleeve 7 rotating in the direction of the arrow f, and transported in the direction thereof. The doctor blade 9 regulates the amount of the transported developer, and the regulated developer is fed to a developing area where the photoreceptor 8 and the developing sleeve 7 face each other. In the developing area, the toner in the developer is electrostatically transferred to an electrostatic latent image on the surface of the photoreceptor 8 and the electrostatic latent image is visualized as a toner image.

The photoreceptor 8 and the developing sleeve 7 preferably have a gap of from 0.01 to 0.7 mm therebetween. When less than 0.01 mm, the transportability of the developer deteriorates, resulting in deterioration of solid image uniformity. When greater than 0.7 mm, the charge buildability and retainability thereof deteriorate.

25FRI in the present invention is determined using a powder fluidity analyzer FT-4 from SYSMEX CORPORATION.

Figure 11:
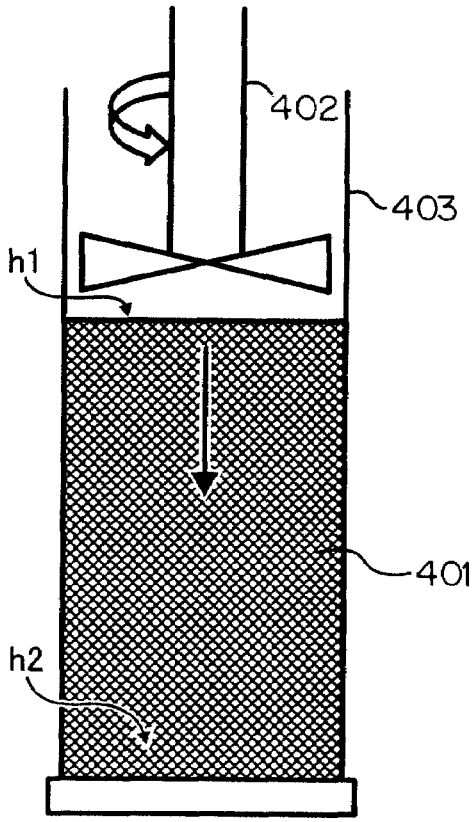
FIG. 11 is a schematic view illustrating a powder fluidity analyzer for use in the present invention.

FIG. 11 is a schematic view illustrating the powder fluidity analyzer. A spiral rotating blade 402 goes through a developer 401 in a glass tube 403 rotating from a surface h1 to a vicinity of bottom h2 thereof, and the rotary torque and vertical load (and total energy which is an integral sum of both) are determined as follows:

(1) more than 25 ml of a developer 401 idly agitated in an image developer for 10 min are placed in the glass tube 403 having a diameter of 25 mm and a height of 101.9 mm;

(2) the developer 401 is subjected to a conditioning by moving the blade 402 having a diameter of 23.5 mm in and out from the surface h1 to the bottom h2 of the developer 401 for 4 times;

(3) the developer 401 is struck to just have a volume of 25 ml;

(4) the rotary torque and vertical load at a blade revolution of 100 mm/s are continuously measured for 7 times to decrease an error tolerance due to a difference of sampling status of the developer 401, and total energy which is an integral sum of the rotary torque and vertical load measured at the $7^{th}$ time is determined total energy at 100 mm/s; and (5) the rotary torque and vertical load at each blade revolution of 100 mm/s, 70 mms, 40 mm/s and 10 mm/s are continuously measured, and total energy which is an integral sum of those measured at a blade revolution of 10 mm/s is determined total energy at 10 mm/s.

As mentioned above, 25 FRI is determined by the following formula:

$$25FRI=(\text{total energy at 10 mm/s}/\text{total energy at 100 mm/s})$$

In the present invention, 25FRI is to be from 0 to 2.0, and preferably from 1.2 to 2.0.

The carrier of the present invention preferably has a weight-average particle diameter of from 15 to 45 μm in terms of fluidity, friction chargeability with a toner and a coverage thereof over the carrier relating to toner scattering. When less than 15 μm, the carrier adheres to a photoreceptor, resulting in hollow images. When greater than 45 μm, latent image reproducibility and toner scattering become worse particularly when combined with a toner having a small particle diameter.

Further, the carrier includes a core material and a resin coating layer thereon, and further the resin coating layer preferably includes a non-conductive particulate material. The carrier has moderate concavities and convexities with the non-conductive particulate material, which not only prevents but also scrapes the spent toner. In addition, the carrier has uniform chargeability therewith and prevention of producing foggy images can be improved.

The non-conductive particulate materials preferably include aluminum oxide, titanium dioxide, zinc oxide, silicon dioxide, barium sulfate and zirconium oxide having a weight-average particle diameter of from 5 to 1,000 nm in terms of spent toner removal, firmness of the resin coating layer, charge buildability and retainability and fluidity. These can be used alone or in combination.

Further, the non-conductive particulate material can control the electric resistivity of the resin coating layer while keeping the strength thereof and the surface shape of the carrier.

In the present invention, the non-conductive particulate materials have an electric resistivity greater than 500 Ω·cm and differ from typical non-conductive particulate materials.

The carrier of the present invention preferably has a volume resistivity of from 10 [Log(Ω·cm)] to 16 [Log(Ω·cm)]. When less than 10 [Log(Ω·cm)], the carrier tends to adhere to non-image areas. When greater than 16 [Log(Ω·cm)], the edge effect deteriorates. When less than the minimum resistivity measurable by a high resistance meter, the carrier substantially has no volume resistivity and is considered to be broken down.

The volume resistivity is measured as follows:

placing a carrier between parallel electric poles having a gap of 2 mm therebetween;

tapping the carrier;

applying a DC voltage of 1,000 V between the electric poles for 30 sec; and measuring a DC resistance by a high resistance meter.

The resin coating layer preferably includes a silicone resin as a binder resin. Having a low surface energy, the silicone resin can prevent the spent toner.

Specific examples of the silicone resin include any known silicone resins such as straight silicones and silicones modified with a resin such as an alkyd resin, a polyester resin, an epoxy resin, an acrylic resin and a urethane resin. Specific examples of marketed products of the straight silicones include, but are not limited to, KR271, KR255 and KR152 from Shin-Etsu Chemical Co., Ltd; and SR2400, SR2406 and SR2410 from Dow Corning Toray Silicone Co., Ltd. The straight silicone resins can be used alone, and a combination with other constituents crosslinking therewith or charge controlling constituents can also be used. Specific examples of the modified silicones include, but are not limited to, KR206 (alkyd-modified), KR5208 (acrylic-modified), ES1001N (epoxy-modified) and KR305 (urethane-modified) from Shin-Etsu Chemical Co., Ltd; and SR2115 (epoxy-modified) and SR2110 (alkyd-modified) from Dow Corning Toray Silicone Co., Ltd.

The binder resin may be an acrylic resin. Having strong adhesiveness and low brittleness, the acrylic resin stably maintains the coated film, preventing the coated film from being abraded and separating. Further, the particulate material included therein is strongly maintained, particularly when having a particle diameter larger than the average thickness thereof.

Specific examples of the acrylic resin include known acrylic resins. The acrylic resin can be used alone, and a combination with at least one other constituent crosslinking therewith can also be used. Specific examples of the other constituent crosslinking therewith include amino resins such as guanamine and a melamine resin; and acidic catalysts. Specific examples of the acidic catalysts include any materials having a catalytic influence, e.g., materials having a reactive group such as a complete alkyl group, a methylol group, an imino group and a methylol/imino group.

The binder resin preferably includes both an acrylic resin and a silicone resin. Since the acrylic resin has a high surface energy, a toner tends to stick to the carrier and accumulate thereon, resulting in deterioration of charge quantity thereof. The silicone resin having a low surface energy solves this problem when used with the acrylic resin. It is important to balance the properties of the two resins because the silicone resin has low adhesiveness and high brittleness. Then, a toner is difficult to stick to the coated film, and which has good abrasion resistance.

The binder resin is preferably from 0.1 to 1.5% by weight based on total weight thereof and the core material. When less than 0.1% by weight, the coated film does not sufficiently work. When greater than 1.5% by weight, the coated film is more abraded.

The content of the binder resin is determined by the following formula:

The content of the binder resin (weight %)=[total weight of solid contents of coating resin/(total weight of solid contents of coating resin+weight of core material)]×100.

The carrier of the present invention preferably includes non-conductive and conductive particulate materials in an amount of from 10 to 70% by weight. When less than 10% by weight, a strong stress to the binder resin cannot effectively be reduced. When greater than 70% by weight, the chargeability of the carrier deteriorates and the particulate material is insufficiently maintained. The content of the non-conductive and conductive particulate materials is determined by the following formula:

The content of the non-conductive and conductive particulate materials (weight %)=[weight of non-conductive and conductive particulate materials/(weight of non-conductive and conductive particulate materials+total weight of solid contents of coating resin)]×100.

The carrier of the present invention preferably has a magnetization of from 40 $\mu m^2$/kg to 90 $\mu m^2$/kg at 1,000 Oe, when gaps between the carriers are suitably maintained and a toner is smoothly dispersed with the carrier in a developer. When less than 40 A $m^2$/kg at 1,000 Oe, the carrier adherence tends to occur. When greater than 90 A $m^2$/kg, an ear (magnetic brush) of the developer when developing becomes hard, resulting in deterioration of reproducibility of image details.

Specific examples of an inorganic particulate material as an external additive added to the toner of the present invention include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, and the like. Among these materials, metal oxides, metal nitrides and metal carbonates are preferably used to achieve the above-mentioned specific scope of 25FRI. The inorganic particulate material preferably has a number-average particle diameter of from 8 to 80 nm and from 120 to 300 nm. Silica, alumina and titanium oxide are preferably used, and silica and titanium oxide are more preferably used. Further, titanium oxide having a number-average primary particle diameter of from 5 to 40 nm is much more preferably used for the chargeability and fluidity of the toner. The toner preferably includes the inorganic particulate material in an amount of from 0.01 to 5% by weight.

As a means of controlling the fluidity of a toner, not only controlling the conditions of preparing an external additive, the external additive are effectively pulverized and sieved after prepared. Further, the way of attaching the external additive to the surface of a toner and the status of the external additive attached thereto are important.

As an external additive, the inorganic particulate material and a hydrophobized inorganic particulate material can be combined. At least a small-size hydrophobized inorganic particulate material having an average primary particle diameter of from 1 to 20 nm, and more preferably from 6 to 15 nm (a specific surface area of from 100 to 400 $m^2$/g when measured by a BET method) and a large-size hydrophobized inorganic particulate material having an average primary particle diameter of from 30 to 150 nm, and more preferably from 90 to 130 nm (a specific surface area of from 20 to 100 $m^2/g$ when measured by a BET method) are preferably present on the surface of a toner.

The small-size hydrophobized inorganic particulate material is preferably silica or titanium oxide, and more preferably a combination thereof. The large-size hydrophobized inorganic particulate material is preferably silica. Further, the silica is preferably prepared by wet methods such as a sol-gel method. Furthermore, a middle-size hydrophobized inorganic particulate material, preferably silica, having an average primary particle diameter of from 20 to 50 nm (a specific surface area of from 40 to 100 $m^2/g$ when measured by a BET method) is preferably present on the surface of a toner.

Specific examples of the inorganic particulate material and hydrophobized inorganic particulate material include any known inorganic particulate materials such as silica fine particles, hydrophobized silica, fatty acid metallic salts such as zinc stearate and aluminium stearate, metal oxides such as titania, alumina, tin oxide and antimony oxide and fluoropolymers.

Particularly, the hydrophobized silica, titania and alumina fine particles are preferably used. Specific examples of the silica fine particles include HDK H 2000, HDK H 2000/4, HDK H 2050EP and HVK21 from Hoechst AG; and R972, R974, RX200, RY200, R202, R805 and R812 from Nippon Aerosil Co. Specific examples of the titania fine particles include P-25 from Nippon Aerosil Co.; ST-30 and STT-65C-S from Titan Kogyo K.K.; TAF-140 from Fuji Titanium Industry Co., Ltd.; MT150W, MT-500B and MT-600b from Tayca Corp. Specific examples of the hydrophobized titanium oxide fine particles include T-805 from Nippon Aerosil Co.; STT-30A and STT-65S-S from Titan Kogyo K. K.; TAF-500T and TAF-1500T from Fuji Titanium Industry Co., Ltd.; MT-100S and MT100T from Tayca Corp.; IT-S from Ishihara Sangyo Kaisha Ltd.

To prepare the hydrophobized silica fine particles, titania fine particles or alumina fine particles, hydrophilic fine particles are subjected to silane coupling agents such as methyltrimethoxy silane, methyltriethoxy silane and octylmethoxy silane. Inorganic fine particles optionally subjected to a silicone oil upon application of heat is preferably used.

Specific examples of the silicone oil include dimethyl silicone oil, methylphenyl silicone oil, chlorphenyl silicone oil, methylhydrogen silicone oil, alkyl modified silicone oil, fluorine modified silicone oil, polyether modified silicone oil, alcohol modified silicone oil, amino modified silicone oil, epoxy modified silicone oil, epoxy-polyether modified silicone oil, phenol modified silicone oil, carboxyl modified silicone oil, mercapto modified silicone oil, acryl modified silicone oil, methacryl modified silicone oil and $\alpha$-methylstyrene modified silicone oil. Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide and silicon nitride. Particularly, the silica and titanium dioxide are preferably used. The toner preferably includes the inorganic particulate material in an amount of from 0.1 to 5% by weight and more preferably from 0.3 to 3% by weight. The inorganic particulate material preferably has an average primary particle diameter not greater than 100 nm, and more preferably of from 3 to 70 nm. When less than 3 nm, the inorganic particulate material is buried in the toner. When greater than 100 nm, the surface of a photoreceptor is damaged.

Besides, polymer particulate materials, e.g., polystyrene, ester methacrylate and ester acrylate copolymers formed by soap-free emulsifying polymerization, suspension polymerization and dispersion polymerization; polycondensated particulate materials such as silicone, benzoguanamine and nylon; and polymerized particulate materials formed of thermosetting resins can be used.

Such fluidizers can be surface-treated with a surface treatment agent to increase the hydrophobicity to prevent deterioration of fluidity and chargeability even in an environment of high humidity. Specific examples of the surface treatment agent include a silane coupling agent, a sililating agents a silane coupling agent having an alkyl fluoride group, an organic titanate coupling agent, an aluminium coupling agent a silicone oil and a modified silicone oil.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from 0.01 to 1 μm.

As a method of adding the additive, not only a dry external addition method using HENSCHEL MIXER, Q-MIXER, but also a wet external addition method using a solvent or water, and optionally an activator to improve wettability is effectively used.

The dry external addition method mixes and stirs a parent toner and an external additive with a mixer while pulverizing the external additive to cover the surface of the parent toner therewith. It is important to uniformly and firmly attach the external additive such as an inorganic particulate material and a particulate resin thereto in terms of durability of the resultant toner. The shape the mixer blade, the number of revolutions thereof, the mixing time, the number of times of mixing, the amount of the external additive, the amount of the parent toner, the surfaceness such as concavities and convexities, hardness and viscoelasticity are essential factors therefor.

The wet external addition method attaches an inorganic particulate material to the parent toner in a liquid. The inorganic particulate material may be attached thereto after formed in water and a surfactant are removed therefrom. An excessive surfactant present in water is removed by subjecting the water to a solid-liquid separation such as filtration and centrifugal separation to prepare a cake or a slurry. The cake or slurry is re-dispersed in an aqueous medium, and an inorganic particulate material is further added thereto and dispersed. The inorganic particulate material may be dispersed before in the aqueous medium, and when dispersed with a surfactant having a reverse polarity, the inorganic particulate material is more efficiently attached to the surface of a toner. When the inorganic particulate material is hydrophobized and difficult to disperse in an aqueous medium, it may be dispersed with a small amount of alcohol such that an interface tension thereof decreases to be easier to wet. Then, an aqueous solution of the surfactant having a reverse polarity is gradually added to the dispersion. The surfactant having a reverse polarity is preferably used in an amount of from 0.01 to 1% by weight based on total weight of solid contents of a toner. The surfactant having a reverse polarity neutralizes a charge of the inorganic particulate material in the aqueous medium, and the inorganic particulate material agglutinates and adheres to the surface of a toner. The inorganic particulate material is preferably used in an amount of from 0.01 to 5% by weight based on total weight of solid contents of a toner.

The inorganic particulate material attached thereto is fixed thereon by heating the slurry, which also prevents it from releasing therefrom. The slurry is preferably heated at a temperature higher than a glass transition temperature of a resin constituting the toner. After dried, the slurry may further be heated while preventing the inorganic particulate material from agglutinating.

In addition, a metal salt stearate may be mixed therewith as a lubricant to decrease a friction coefficient and increase cleanability of the surface of a photoreceptor. Zinc stearate is preferably used.

Next, a method of preparing the toner including an external additive will be explained.

Recently, the particle diameter of a toner tends to be smaller to produce high definition and high quality images. The toner may have smaller particle diameters by a typical kneading and pulverizing method. However, the kneading and pulverizing method has a limit of minimizing the particle diameter and high cost of production due to an energy consumed and a low yield.

Therefore, polymerization methods such as a suspension polymerization method, an emulsifying polymerization condensation method and a dispersion polymerization method are proposed.

The toner of the present invention preferably has a volume-average particle diameter (Dv) of from 2 to 8 μm and a ratio (Dv/Dn) thereof to a number-average particle diameter (Dn) of from 1.00 to 1.40.

A toner having a small particle diameter can finely be attached to a latent image. However, when the volume-average particle diameter is smaller than 2 μm, the resultant toner in a two-component developer melts and adheres to a surface of a carrier to deteriorate chargeability thereof when agitated for a long time in an image developer. When the volume-average particle diameter is larger than 8 μm, the resultant toner has difficulty in producing high resolution and quality images. In addition, the resultant toner has a large variation of the particle diameters in many cases after the toner in a developer is consumed and fed for long periods.

When Dv/Dn is less than 1.00, each toner is uniformly charged and has high transferability, and high-quality images with less foggy images can be produced. However, when greater than 1.40, charge amount distribution of the resultant toner widens and the images having poor image resolution are produced.

The average particle diameter and particle diameter distribution of the toner can be measured by a Coulter counter TA-II or Coulter Multisizer II from Beckman Coulter, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

In the present invention, an Interface producing a number distribution and a volume distribution from Nikkaki Bios Co., Ltd. and a personal computer PC9801 from NEC Corp. are connected with the Coulter Multisizer II to measure the average particle diameter and particle diameter distribution.

The toner of the present invention preferably has a shape factor SF-1 of from 100 to 180, and a shape factor SF-2 of from 100 to 180.

Figure 2A:
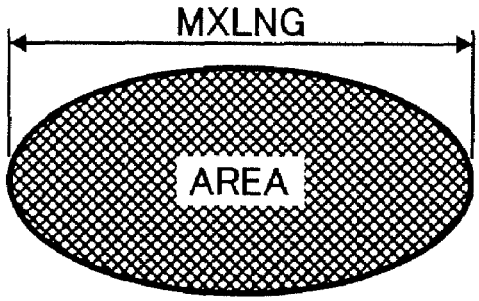
FIGS. 2A and 2B are schematic views illustrating the shapes of toners for explaining shape factors SF-1 and SF-2.
Figure 2B:
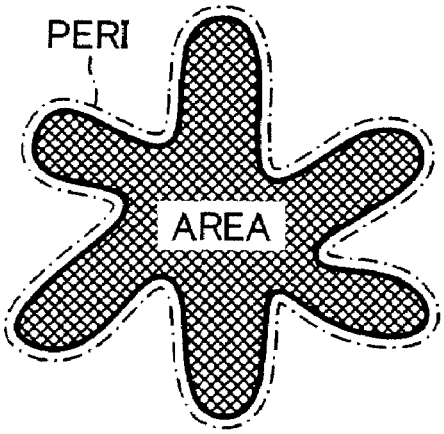

FIGS. 2A and 2B are schematic views illustrating shapes of toners for explaining shape factors SF-1 and SF-2. The shape factor SF-1 represents a degree of roundness of a toner, and is determined in accordance with the following formula (1):

$$\text{SF-1}=\{(MXLNG)^2/\text{AREA}\}\times(100/4\Sigma) \quad (1)$$

wherein MXLNG represents an absolute maximum length of a particle and AREA represents a projected area thereof.

When the SF-1 is 100, the toner has the shape of a complete sphere. As SF-1 becomes greater, the toner becomes more amorphous.

SF-2 represents the concavity and convexity of the shape of the toner, and specifically a square of a peripheral length of an image projected on a two-dimensional flat surface (PERI) is divided by an area of the image (AREA) and multiplied by 100/4τ to determine SF-2 as the following formula (2) shows.

$$\text{SF-2}=\{(PERI)^2/\text{AREA}\}\times(100/4\tau) \quad (2)$$

When SF-2 is 100, the surface of the toner has less concavities and convexities. As SF-2 becomes greater, the concavities and convexities thereon become more noticeable.

When the shape of a toner is close to a sphere, the toner contacts the other toner or a photoreceptor at a point. Therefore, the toners adhere less to each other and have higher fluidity. In addition, the toner and the photoreceptor adhere less to each other, and transferability of the toner improves. When the SF-1 is greater than 180, the resultant toner has an amorphous shape, and the developability and transferability thereof deteriorate. Since a spherical toner tends to come in a gap between the photoreceptor and a cleaning blade, SF-1 and SF-2 are preferably large in the above-mentioned scope. When SF-1 and SF-2 are larger than the above-mentioned scope, the toner scatters on the resultant images, resulting in deterioration of image quality.

The shape factors are measured by photographing the toner with a scanning electron microscope (S-800) from Hitachi, Ltd. and analyzing the photographed image of the toner with an image analyzer Luzex III from NIRECO Corp.

The toner of the present invention is preferably formed by a crosslinking and/or an elongation reaction of a toner constituent liquid including at least polyester prepolymer having a functional group including a nitrogen atom, polyester, a colorant and a release agent are dispersed in an organic solvent in an aqueous medium. Hereinafter, the toner constituents will be explained.

The toner of the present invention preferably includes a modified polyester (i) as a binder resin. The modified polyester (i) includes a bonding group except an ester bond or covalently-bonded or ion-bonded resins having different constitutions. Specifically, a functional group such as a carboxylic acid group and an isocyanate group reactive with a hydroxyl group is introduced to the end of polyester, and which is further reacted with a compound including an active hydrogen atom to be modified.

Specific examples of the modified polyester (i) include reaction products between polyester prepolymers (A) having an isocyanate group and amines (B). The polyester prepolymer (A) is formed from a reaction between polyester having an active hydrogen atom formed by polycondensation between polyol (PO) and a polycarboxylic acid (PC), and polyisocyanate (PIC). Specific examples of the groups including the active hydrogen include a hydroxyl group (an alcoholic hydroxyl group and a phenolic hydroxyl group), an amino group, a carboxyl group, a and mercapto group. In particular, the alcoholic hydroxyl group is preferably used.

As the polyol (PO), diol (DIO) and triol (TO) can be used, and the DIO alone or a mixture of the DIO and a small amount of the TO is preferably used. Specific examples of the DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylic acid (TC) can be used. The DIC alone, or a mixture of the DIC and a small amount of the TC are preferably used. Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the PIC include aliphatic polyisocyanate such as tetramethylenediisocyanate, hexamethylenediisocyanate and 2,6-diisocyanatemethylcaproate; alicyclic polyisocyanate such as isophorondiisocyanate and cyclohexylmethanediisocyanate; aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

A content of the PIC in the polyester prepolymer (A) having a polyisocyanate group is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) reacted with the polyester prepolymer (A) include diamines (B1), polyamines (B2) having three or more amino groups, amino alcohols (B3), amino mercaptans (B4), amino acids (B5) and blocked amines (B6) in which the amines (B1-B5) mentioned above are blocked. Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoronediamine); aliphatic diamines (e.g., ethylene diamine, tetramethylene diamine and hexamethylene diamine). Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds. Among these amines (B), diamines (B1) and mixtures in which a diamine is mixed with a small amount of a polyamine (B2) are preferably used.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than ½, molecular weight of the urea-modified polyester decreases, resulting in deterioration of hot offset resistance of the resultant toner.

The urea-modified polyester may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The modified polyester (i) can be prepared by a method such as a one-shot method or a prepolymer method. The weight-average molecular weight of the modified polyester (i) is not less than 10,000, preferably from 20,000 to 10,000, 000 and more preferably from 30,000 to 1,000,000. When the weight-average molecular weight is less than 10,000, hot offset resistance of the resultant toner deteriorates. The number-average molecular weight of the urea-modified polyester is not particularly limited when the after-mentioned unmodified polyester resin is used in combination. Namely, the weight-average molecular weight of the modified polyester (i) has priority over the number-average molecular weight thereof when combined with an unmodified polyester (ii) mentioned later. However, when the modified polyester (i) is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

A reaction terminator can optionally be used in the crosslinking and/or elongation reaction between the (A) and (B) to control a molecular weight of the resultant urea-modified polyester. Specific examples of the reaction terminators include monoamines such as diethylamine, dibutylamine, butylamine and laurylamine; and their blocked compounds such as ketimine compounds.

The molecular weight of the resultant polymer can be measured by a gel permeation chromatography (GPC) method using tetrahydrofuran as a solvent.

In the present invention, an unmodified polyester resin (ii) can be used in combination with the modified polyester resin (i) as a toner binder resin. It is more preferable to use the unmodified polyester resin (ii) in combination with the modified polyester resin than to use the modified polyester resin alone because a low-temperature fixability and a glossiness of full color images of the resultant toner improve. Specific examples of the unmodified polyester resin (ii) include polycondensated products between the polyol (PO) and polycarboxylic acid (PC) similarly to the modified polyester resin (i), and products preferably used are the same as those thereof. The unmodified polyester (ii) can be substituted with another modified polyester other than a urea-modified polyester such as a urethane-modified polyester. It is preferable that the modified polyester resin (i) and unmodified polyester resin (ii) are partially soluble each other in terms of the low-temperature fixability and hot offset resistance of the resultant toner. Therefore, the modified polyester resin (i) and unmodified polyester resin (ii) preferably have similar compositions. When the unmodified polyester resin (ii) is used in combination, a weight ratio ((i)/(ii)) between the modified polyester resin (i) and unmodified polyester resin (ii) is from 5/95 to 75/25, preferably from 10/90 to 25/75, more preferably from 12/88 to 25/75, and most preferably from 12/88 to 22/78. When the modified polyester resin (i) has a weight ratio less than 5%, the resultant toner has a poor hot offset resistance, and has a difficulty in having a thermostable preservability and a low-temperature fixability.

The unmodified polyester resin (ii) preferably has a peak molecular weight of from 1,000 to 10,000, preferably from 2,000 to 8,000, and more preferably from 2,000 to 5,000. When less than 1,000, the thermostable preservability of the resultant toner deteriorates. When greater than 10,000, the low-temperature fixability thereof deteriorates. The unmodified polyester resin (ii) preferably has a hydroxyl value not less than 5 mg KOH/g, more preferably of from 10 to 120 mg KOH/g, and most preferably from 20 to 80 mg KOH/g. When less than 5 mg KOH/g, the resultant toner has a difficulty in having a thermostable preservability and a low-temperature fixability. The unmodified polyester resin (ii) preferably has an acid value of from 1 to 5 mg KOH/g, and more preferably from 2 to 4 mg KOH/g. A wax having a high acid value is used in the present invention, and a binder preferably has a low acid value because the resultant toner has good chargeability and volume resistivity, which is suitable for a two-component developer.

The binder resin of the present invention preferably has a glass transition temperature (Tg) of from 35 to 70° C., and more preferably from 55 to 65° C. When less than 35° C., a thermostable preservability of the resultant toner deteriorates. When greater than 70° C., a low-temperature fixability thereof is insufficient. The toner of the present invention has a better thermostable preservability than known polyester toners even though the glass transition temperature is low because the urea-modified polyester is easy to be present at the surface of a parent toner particle.

The glass transition temperature (Tg) can be measure by a differential scanning calorimeter (DSC).

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight. The colorant for use in the present invention can be used as a master batch pigment when combined with a resin.

Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; or their copolymers with vinyl compounds; polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin and paraffin waxes. These resins are used alone or in combination.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and salicylic acid derivatives. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group and a quaternary ammonium group. Among these materials, materials negatively charging a toner are preferably used.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

A wax for use in the toner of the present invention as a release agent has a low melting point of from 50 to 120° C. When such a wax is included in the toner, the wax is dispersed in the binder resin and serves as a release agent at a location between a fixing roller and the toner particles. Thereby, hot offset resistance can be improved without applying an oil to the fixing roller used. Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

These charge controlling agents and release agents can be dissolved and dispersed after kneaded upon application of heat together with a master batch pigment and a binder resin, and can be added when directly dissolved or dispersed in an organic solvent.

As an external additive supplementing the fluidity, developability and chargeability of a toner, the above-mentioned external additives are used.

The toner of the present invention is produced by the following method, but the method is not limited thereto.

1) A colorant, an unmodified polyester, a polyester prepolymer having an isocyanate group (A) and a release agent are dispersed in an organic solvent to prepare a toner constituent liquid.

The organic solvent is preferably a volatile solvent having a boiling point less than 100° C. because of being easily removed after a toner particle is formed. Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, methyl ethyl ketone and methyl isobutyl ketone. These can be used alone or in combination. Particularly, aromatic solvents such as the toluene and xylene and halogenated hydrocarbons such as the methylene chloride, 1,2-dichloroethane, chloroform and carbon tetrachloride. A content of the organic solvent is typically from 0 to 300 parts by weight, preferably from 0 to 100 parts by weight, and more preferably from 25 to 70 parts by weight per 100 parts by weight of the polyester prepolymer.

2) The toner constituent liquid is emulsified in an aqueous medium in the presence of a surfactant and a particulate resin.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

A content of the water medium is typically from 50 to 2,000 parts by weight, and preferably from 100 to 1,000 parts by weight per 100 parts by weight of the toner constituent liquid. When the content is less than 50 parts by weight, the toner constituent liquid is not well dispersed and a toner particle having a predetermined particle diameter cannot be formed. When the content is greater than 20,000 parts by weight, the production cost increases.

A dispersant such as a surfactant and particulate resin is optionally included in the aqueous medium to improve the dispersion therein.

Specific examples of the surfactants include anionic surfactants such as alkylbenzene sulfonic acid salts, oolefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin and monoperfluoroalkyl(C6-C16)ethylphosphates.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos).

The particulate resin is included to stabilize a toner particle formed in the aqueous medium. Therefore, the particulate resin is preferably included so as to have a coverage of from 10 to 90% over a surface of the toner particle. Specific examples of the particulate resins include polymethylmethacrylate fine particles having particle diameters of 1 μm and 3 μm, polystyrene fine particles having particle diameters of 0.5 μm and 2 μm and a polystyrene-acrylonitrile fine particle having a particle diameter of 1 μm. These are marketed as PB-200 from Kao Corporation, SGP from Soken Chemical & Engineering Co., Ltd., Technopolymer SB from Sekisui Plastics Co., Ltd., SGP-3G from Soken Chemical & Engineering Co., Ltd. and Micro Pearl from Sekisui Chemical Co., Ltd.

In addition, inorganic dispersants such as tricalcium phosphate, calcium carbonate, titanium oxide, colloidal silica and hydroxy apatite can also be used.

As dispersants which can be used in combination with the above-mentioned resin fine particles and inorganic compounds, it is possible to stably disperse toner constituents in water using a polymeric protection colloid. Specific examples of such protection colloids include polymers and copolymers prepared using monomers such as acids (e.g., acrylic acid, methacrylic acid, ocyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The dispersion method is not particularly limited, and low speed shearing methods, high-speed shearing methods, friction methods, high-pressure jet methods, ultrasonic methods, can be used. Among these methods, high-speed shearing methods are preferably used because particles having a particle diameter of from 2 to 20 μm can be easily prepared. At this point, the particle diameter (2 to 20 μm) means a particle diameter of particles including a liquid. When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

3) While an emulsion is prepared, amines (B) are included therein to be reacted with the polyester prepolymer (A) having an isocyanate group.

This reaction is accompanied by a crosslinking and/or an elongation of a molecular chain. The reaction time depends on reactivity of an isocyanate structure of the prepolymer (A) and amines (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

4) After the reaction is terminated, an organic solvent is removed from an emulsified dispersion (a reactant), which is washed and dried to form a toner particle.

The prepared emulsified dispersion (reactant) is gradually heated while stirred in a laminar flow, and an organic solvent is removed from the dispersion after stirred strongly when the dispersion has a specific temperature to form a toner particle having a shape of spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

5) A charge controlling agent is beat in the toner particle, and inorganic fine particles such as silica fine particles and titanium oxide fine particles are externally added thereto to form a toner.

Known methods using a mixer, are used to beat in the charge controlling agent and to externally add the inorganic fine particles.

Thus, a toner having a small particle diameter and a sharp particle diameter distribution can be obtained. Further, the strong agitation in the process of removing the organic solvent can control the shape of a toner from a sphere to a rugby ball, and the surface morphology thereof from being smooth to a pickled plum.

Figure 3A:
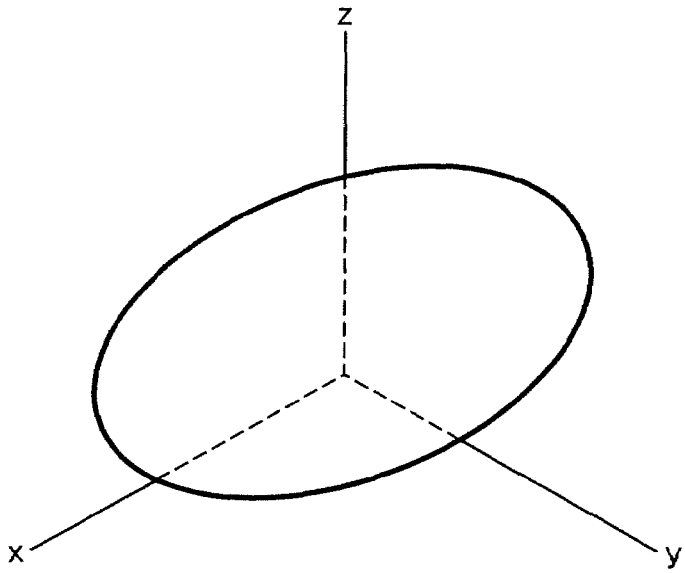
FIGS. 3A, 3B and 3C are schematic views illustrating the shapes of the toner of present invention.
Figure 3B:
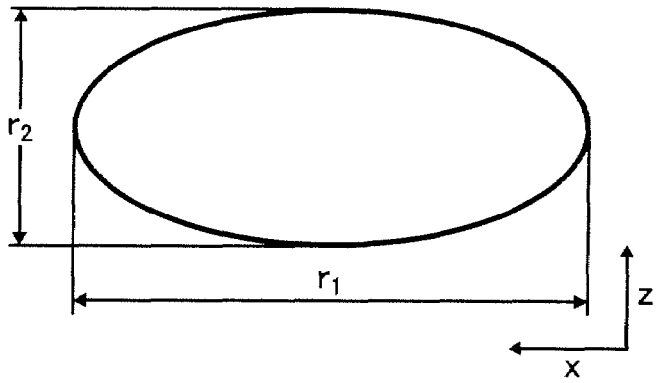
Figure 3C:
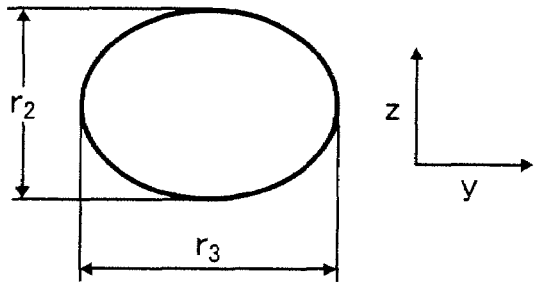

The toner for use in the fixer of the present invention has the shape of almost a sphere, which can be specified as follows. FIG. 3A is an external view of the toner, and FIGS. 3B and 3C are cross sections of the toner, wherein the toner preferably satisfies the following relationship:

$$0.5 \leqq (r_2/r_1) \leqq 1.0 \text{ and } 0.7 \leqq (r_3/r_2) \leqq 1.0$$

wherein $r_1$, $r_2$ and $r_3$ represent the average major axis particle diameter, the average minor axis particle diameter and the average thickness of particles of the toner respectively, and wherein $r_3 \leqq r_2 \leqq r_1$.

When the ratio $(r_2/r_1)$ is too small, the toner has a form far away from the spherical form, and therefore the toner has poor dot reproducibility and transferability, resulting in deterioration of the image quality. When the ratio $(r_3/r_2)$ is too small, the toner has a form far away from the spherical form, and therefore the toner has poor transferability. When the ratio $(r_3/r_2)$ is 1.0, the toner has a form similar to the spherical form, and therefore the toner has good fluidity.

The above-mentioned size factors (i.e., $r_1$, $r_2$ and $r_3$) of toner particles can be determined by observing the toner particles with a scanning electron microscope while the viewing angle is changed.

The toner of the present invention may be mixed with a magnetic carrier when used in a two-component developer, and the magnetic carrier is preferably a ferrite including a bivalent metal such as iron, magnetite, Mn, Zn and Cu and preferably has a volume-average particle diameter of from 15 to 45 μm. When less than 15 μm, the carrier tends to adhere to a photoreceptor. When greater than 45 μm, the carrier is not mixed well with a toner and the resultant toner has insufficient charge amount and poor chargeability. A Cu ferrite including Zn, having a high saturated magnetization, is preferably used, however, a carrier can be selected according to processes of image forming apparatuses such as those in FIGS. 1, 4, 5 and 7 to 9. Resins coating the magnetic carrier are not particularly limited, but include a silicone resin, a styrene-acrylic resin, a fluorine-containing resin and an olefin resin. The resin may be dissolved in a solvent and the solution may be coated on a core in a fluidized bed, or electrostatically attached thereto and thermofused thereon. The coated resin preferably has a thickness of from 0.05 to 10 μm, and more preferably from 0.2 to 5 μm.

The toner of the present invention is preferably used as a color toner because of having good granularity, and good reproducibility of a thin line, a microscopic dot and medium colors.

Figure 4:
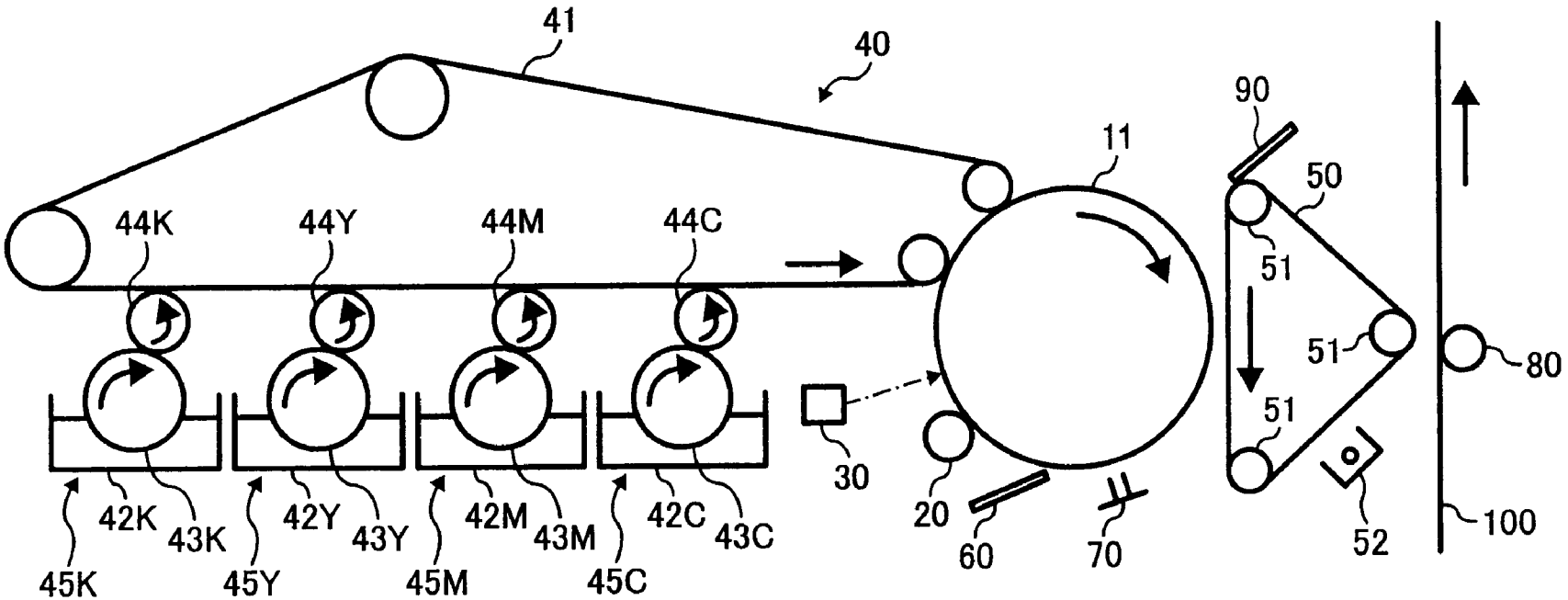
FIG. 4 is a schematic view illustrating an embodiment of the image forming apparatus of the present invention.

The image forming apparatus of the present invention includes a charger applying an alternate electric field to an image bearer to be uniformly charged, and an image developer using the above-mentioned developer. FIG. 4 is a schematic view illustrating an embodiment of the image forming apparatus of the present invention.

Around a photoreceptor drum (hereinafter referred to as a photoreceptor) as an image bearer 11, a charging roller as a charger 20, an irradiator 30, a cleaner having a cleaning blade 60, a discharge lamp as a discharger 70, an image developer 40 and an intermediate transferer 50 are arranged. The intermediate transferer 50 is suspended by plural suspension rollers 51 and endlessly driven by a driver such as a motor (not shown) in a direction indicated by an arrow. Some of the suspension rollers 51 are combined with rolls of transfer bias rollers feeding a transfer bias to the intermediate transferer 50 and a predetermined transfer bias is applied thereto from an electric source (not shown). A cleaner having a cleaning blade 90 cleaning the intermediate transferer 50 is also arranged. A transfer roller 80 transferring a toner image onto a transfer paper 100 as a final transferer is arranged facing the intermediate transferer 50, to which a transfer bias is applied from an electric source (not shown). Around the intermediate transferer 50, a corona charger 52 is arranged as a charger.

The image developer 40 includes a developing belt 41 as a developer bearer, a black (Bk) developing unit 45K, a yellow (Y) developing unit 45Y, a magenta (M) developing unit 45M and a cyan (C) developing unit 45C around the developing belt 41. The developing belt 41 is extended over plural belt rollers, endlessly driven by a driver such as a motor (not shown) in a direction indicated by an arrow and driven at almost a same speed as the photoreceptor 11 at a contact point therewith.

Since each developing unit 45K, 45Y, 45M and 45C has the same configuration, only the black developing unit 45K will be explained, and explanations of other developing units 45Y, 45M and 45C are omitted but the corresponding elements 42Y, 42M, 42C, 43Y, 43M, 43C, 44Y, 44M and 44C are shown in the figures. The developing unit 45K includes a developer tank 42K including a high-viscosity and high-concentration liquid developer including a toner and a carrier liquid, a scoop roller 43K with a bottom dipped in the liquid developer in the developer tank 42K and an application roller 44K applying a thin layer of the developer scooped by the scoop roller 43K to the developing belt 41. The application roller 44K has an electroconductivity and a predetermined bias is applied thereto from an electric source (not shown).

Figure 5:
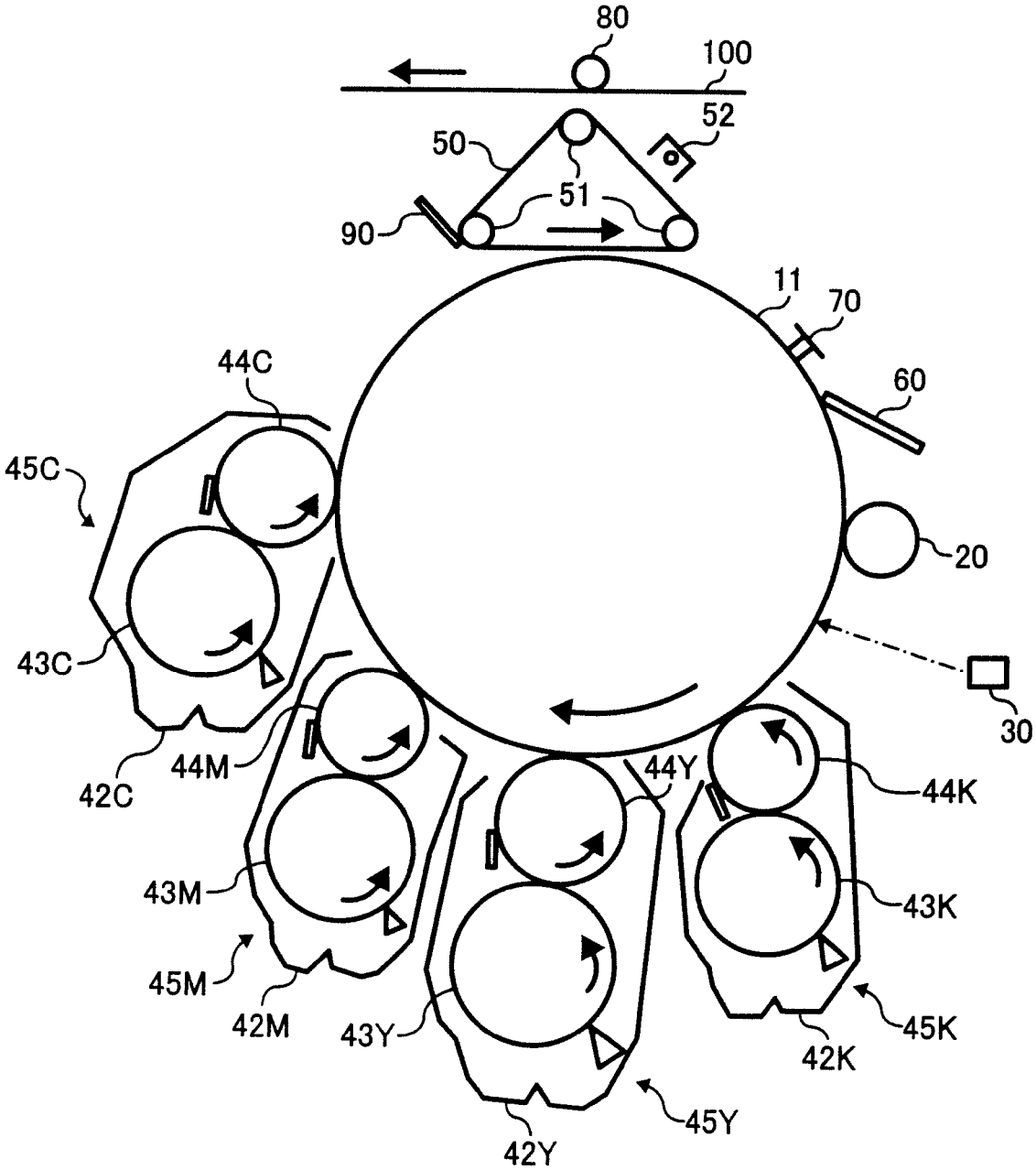
FIG. 5 is a schematic view illustrating another embodiment of the image forming apparatus of the present invention.

In the present invention, besides the embodiment of a full-color copier in FIG. 4, an embodiment of a full-color copier in FIG. 5 wherein developing units 45K, 45Y, 45M and 45C for each color are located around a photoreceptor 11 can be used.

In FIG. 4, after the photoreceptor 11 is uniformly charged rotating in a direction indicated by an arrow, the irradiator 30 irradiates the photoreceptor 11 with an original imagewise light from an optical system (not shown) to form an electrostatic latent image thereon. The electrostatic latent image is developed by the image developer 40 to form a visual toner image thereon. The developer thin layer on the developing belt 41 is released therefrom as it is and transferred onto a part the electrostatic latent image is formed on. The toner image developed by the image developer 40 is transferred onto the surface of the intermediate transferer 50 (first transfer) driven at a same speed as that of the photoreceptor 11 at a contact point (first transfer area) therewith. When three or four colors are overlaid on the intermediate transferer 50 to form a full-color image thereon.

In the rotating direction of the intermediate transferer 50, the corona charger 52 charging the toner image thereon is located at a downstream position of the contact point between the photoreceptor 11 and the intermediate transferer 50, and at an upstream position of a contact point between the intermediate transferer 50 and the transfer paper 100. The corona charger 52 applies a sufficient charge having a same polarity as that of the toner particle to the toner image so as to be transferred well onto the transfer paper 100. After the toner image is charged by the corona charger 52, the toner image is transferred at a time by a transfer bias from the transfer roller 80 onto the transfer paper 100 fed from a paper feeder (not shown) in a direction indicated by an arrow. Then, the transfer paper 100 onto which the toner image is transferred is separated from the photoreceptor 11 by a separator (not shown). After the toner image is fixed thereon by a fixer (not shown), the transfer paper 100 is discharged from the copier. On the other hand, untransferred toner is removed from the photoreceptor 11 by a cleaner including the cleaning blade 60 after the toner image is transferred, and discharged by the discharge lamp 70 to be ready for the following charge.

The intermediate transferer 50 preferably has a static friction coefficient of from 0.1 to 0.6, and more preferably from 0.3 to 0.5. In addition, the intermediate transferer 50 preferably has a volume resistance of from several to $10^3$ Ωcm. When the intermediate transferer 50 has a volume resistance of from several to $10^3$ Ωcm, it is prevented that the intermediate transferer 50 itself is charged and a charge is difficult to remain thereon to prevent an uneven second transfer. Further, a transfer bias can easily be applied thereto.

Materials therefor are not limited and any known materials can be used. Specific examples thereof include:

(1) a single layer belt formed of a material having high Young's modulus (tensile elasticity) such as PC (polycarbonate), PVDF (polyvinylidenefluoride), PAT (polyalkyleneterephthalate), a mixture of PC and PAT, a mixture of ETFE (ethylenetetrafluoroethylene copolymer) and PC, a mixture of ETFE and PAT, a mixture of PC and PAT and a thermosetting polyimide in which carbon black dispersed, which has a small transformed amount against a stress when an image is formed; (2) a two or three layer belt including a surface layer or an intermediate layer based on the above-mentioned belt having high Young's modulus, which prevents hollow line images due to a hardness of the single layer belt; and (3) a belt formed of a rubber and an elastomer having a comparatively low Young's modulus, which has an advantage of scarcely producing hollow line images due to its softness, and being low-cost because of not needing a rib or a meandering inhibitor when the belt is wider than a driving roller and an extension roller such that an elasticity of an edge of the belt projecting therefrom prevents the meandering.

An intermediate transfer belt is conventionally formed of a fluorocarbon resin, a polycarbonate resin and a polyimide resin. However, an elastic belt which is wholly or partially an elastic member is used recently. Transferring a full-color image with a resin belt has the following problems.

A full-color image is typically formed of four colored toners. The full-color image includes one to four toner layers. The toner layer receives a pressure from a first transfer (transfer from a photoreceptor to an intermediate transfer belt) and a second transfer (from the intermediate transfer belt to a sheet), and agglutinability of the toner increases, resulting in production of hollow letter images and edgeless solid images. Since a resin belt has a high hardness and does not transform according to a toner layer, it tends to compress the toner layer, resulting in production of hollow letter images.

Recently, demands for forming an image on various sheets such as a Japanese paper and a sheet purposefully having a concavity and convexity are increasing. However, a paper having a poor smoothness tends to have an air gap with a toner when transferred thereon and hollow images tend to be produced thereon. When a transfer pressure of the second transfer is increased to increase an adhesion of the toner to the paper, agglutinability of the toner increases, resulting in production of hollow letter images.

The elastic belt transforms according to a toner layer and a sheet having a poor smoothness at a transfer point. Since the elastic belt transforms following to a local concavity and convexity, it adheres a toner to a paper well without giving an excessive transfer pressure to a toner layer, and therefore a transfer image having good uniformity can be formed even on a sheet having a poor smoothness without hollow letter images.

Specific examples of the resin for the elastic belt include polycarbonate; fluorocarbon resins such as ETFE and PVDF; styrene resins (polymers or copolymers including styrene or a styrene substituent) such as polystyrene, chloropolystyrene, poly-α-methylstyrene, a styrene-butadiene copolymer, a styrene-vinylchloride copolymer, a styrene-vinylacetate copolymer, a styrene-maleate copolymer, a styrene-esteracrylate copolymer (a styrene-methylacrylate copolymer, a styrene-ethylacrylate copolymer, a styrene-butylacrylate copolymer, a styrene-octylacrylate copolymer and a styrene-phenylacrylate copolymer), a styrene-estermethacrylate copolymer (a styrene-methylmethacrylate copolymer, a styrene-ethylmethacrylate copolymer and a styrene-phenylmethacrylate copolymer), a styrene-α-methylchloroacrylate copolymer and a styrene-acrylonitrile-esteracrylate copolymer; a methylmethacrylate resin; a butyl methacrylate resin; an ethyl acrylate resin; a butyl acrylate resin; a modified acrylic resin such as a silicone-modified acrylic resin, a vinylchloride resin-modified acrylic resin and an acrylic urethane resin; a vinylchloride resin; a styrene-vinylacetate copolymer; a vinylchloride-vinyl-acetate copolymer; a rosin-modified maleic acid resin; a phenol resin; an epoxy resin; a polyester resin; a polyester polyurethane resin; polyethylene; polypropylene; polybutadiene; polyvinylidenechloride; an ionomer resin; a polyurethane resin; a silicone resin; a ketone resin; an ethylene-ethylacrylate copolymer; a xylene resin; a polyvinylbutyral resin; a polyamide resin and a modified-polyphenyleneoxide resin. These can be used alone or in combination. However, these are not limited thereto.

Specific examples of an elastic rubber and an elastomer include a butyl rubber, a fluorinated rubber, an acrylic rubber, EPDM, NBR, an acrylonitrile-butadiene-styrene natural rubber, an isoprene rubber, a styrene-butadiene rubber, a butadiene rubber, an ethylene-propylene rubber, an ethylene-propylene terpolymer, a chloroprene rubber, chlolosulfonated polyethylene, chlorinated polyethylene, a urethane rubber, syndiotactic 1,2-polybutadiene, an epichlorohydrin rubber, a silicone rubber, a fluorine rubber, a polysulfide rubber, a polynorbornene rubber, a hydrogenated nitrile rubber; and a thermoplastic elastomer such as a polystyrene elastomer, a polyolefin elastomer, a polyvinylchloride elastomer, a polyurethane elastomer, a polyamide elastomer, a polyurea elastomer, a polyester elastomer and a fluorocarbon resin elastomer. These can be used alone or in combination. However, these are not limited thereto.

Specific examples of a conductant controlling a resistivity include a metallic powder such as carbon black, graphite, aluminium and nickel; and an electroconductive metal oxide such as a tin oxide, a titanium oxide, a antimony oxide, an indium oxide, kalium titanate, an antimony oxide-tin oxide complex oxide and an indium oxide-tin oxide complex oxide. The electroconductive metal oxide may be coated with an insulative particulate material such as barium sulfate, magnesium silicate and calcium carbonate. These are not limited thereto.

A surface layer material of the elastic material does not contaminate the photoreceptor and decreases surface friction of a transfer belt to increase cleanability and second transferability of a toner. For example, one, or two or more of a polyurethane resin, a polyester resin and an epoxy resin can reduce a surface energy and increase a lubricity. A powder or a particulate material of one, or two or more of a fluorocarbon resin, a fluorine compound, fluorocarbon, a titanium dioxide, silicon carbide can be also used. A material having a surface layer including many fluorine atoms when heated, and having a small surface energy such as a fluorinated rubber can also be used.

Figure 6:
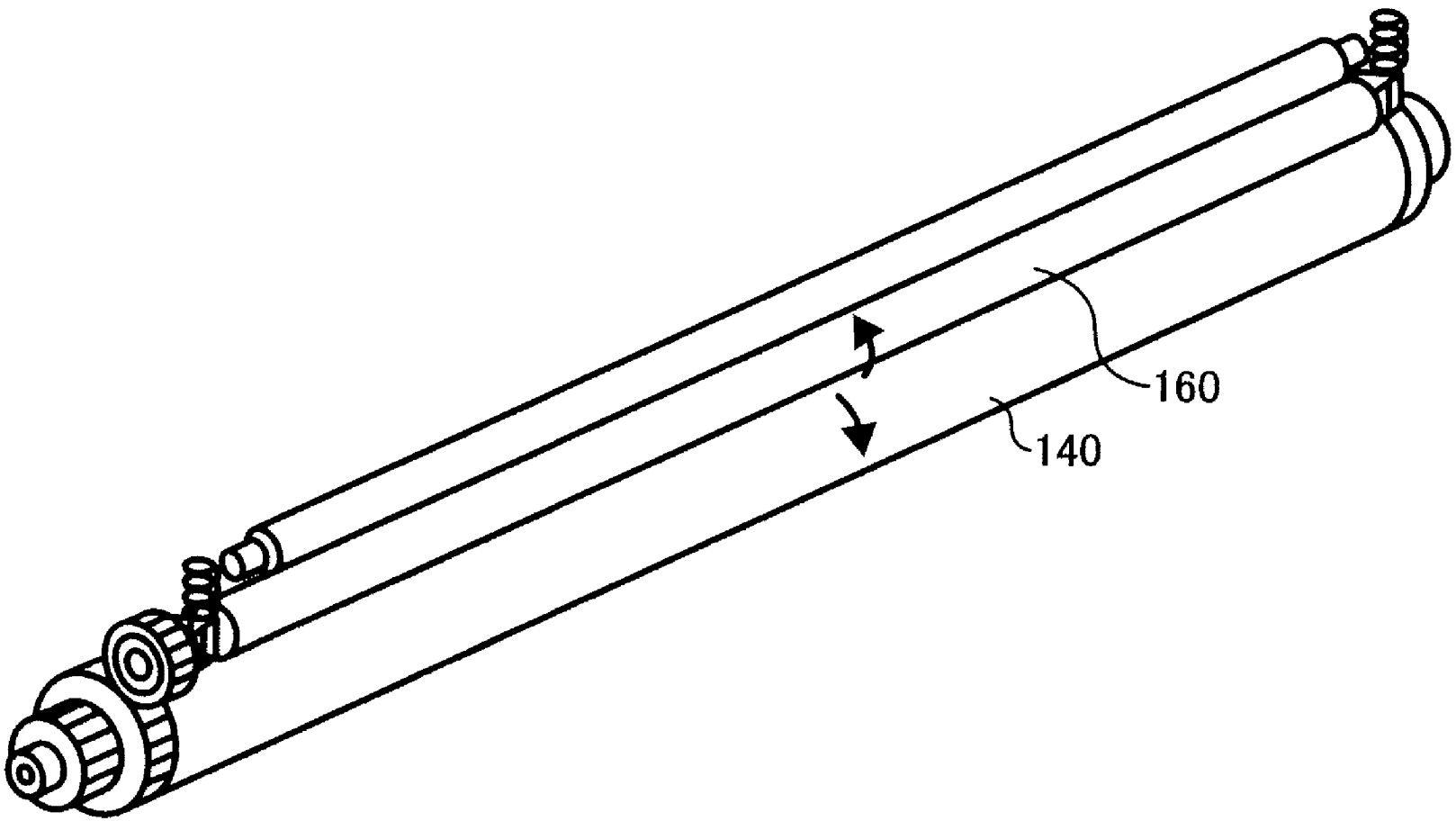
FIG. 6 is a schematic view illustrating a further embodiment of the image forming apparatus of the present invention, using a contact charger.

FIG. 6 is a schematic view illustrating a further embodiment of the image forming apparatus of the present invention, using a contact charger. A photoreceptor drum 140 as an image bearer to be charged is rotated in the direction of an arrow at a specific (process) speed. A charging roller 160 contacting the photoreceptor drum 140 basically includes a cylindrical metal core and a roller-shaped conductive rubber layer concentrically formed on the cylindrical metal core. Both ends of the charging roller 160 are rotatably held on bearing members (not shown) and pressed to the photoreceptor drum 140 at a specific pressure by a pressurizer (not shown). The charging roller 160 is rotated by the rotation of the photoreceptor drum 140. The charging roller 160 has a diameter of 15 mm, formed of a metal core having a diameter of 9 mm and a middle-resistive rubber layer having a resistivity of about 100,000Ω·cm.

The charging roller 160 is electrically connected with an electric source (not shown), and a specific bias is applied to the charging roller 160 thereby. Then, the circumferential surface of the photoreceptor drum 140 is uniformly charged to have a specific polarity and a specific potential.

Chargers for use in the present invention are not limited to the above-mentioned contact chargers, and may be non-contact chargers. However, the contact chargers are preferably used because of generating less ozone.

Further, in the image forming apparatus of the present invention, an alternating electric field is applied to the charger. A DC electric field forms much $O_3^-$ and $NO_3^-$. These ozone and nitroxide adhere to a photoreceptor and the surface thereof deteriorates. Particularly, the surface of the photoreceptor is hardened and is largely abraded, and external additives tend to adhere thereto because of a smaller friction coefficient, resulting in filming thereof over the surface of the photoreceptor. Therefore, an alternating electric field overlapped with an AC electric field is applied to the charger to prevent the generation of ozone and nitroxide, and to uniformly charge the photoreceptor. Particularly, the alternating electric field generates $H_3O^+$ having a reverse polarity, which neutralizes the ozone to prevent the deterioration of the photoreceptor.

The charger for use in the present invention may have any shape besides the roller, such as magnetic brushes and fur brushes, and is selectable according to a specification or a form of the electrophotographic image forming apparatus. The magnetic brush is formed of various ferrite particles such as Zn—Cu ferrite as a charging member, a non-magnetic electroconductive sleeve supporting the charging member and a magnet roll included by the non-magnetic electroconductive sleeve. The fur brush is a charger formed of a shaft subjected to an electroconductive treatment and a fur subjected to an electroconductive treatment with, e.g., carbon, copper sulfide, metals and metal oxides winding around or adhering to the shaft.

Figure 7:
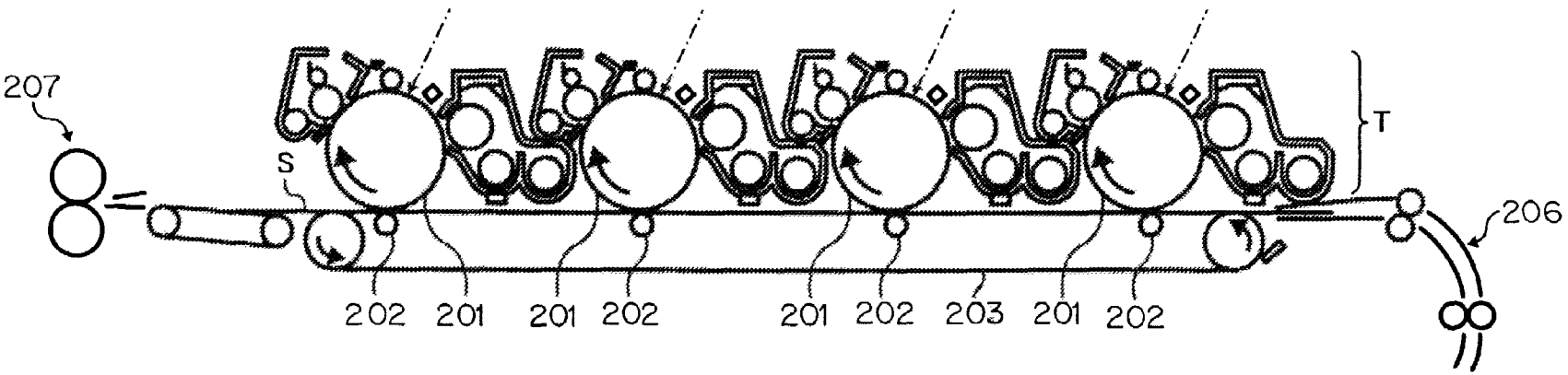
FIG. 7 is a schematic view illustrating an embodiment of a tandem full-color image forming apparatus of the present invention.
Figure 8:
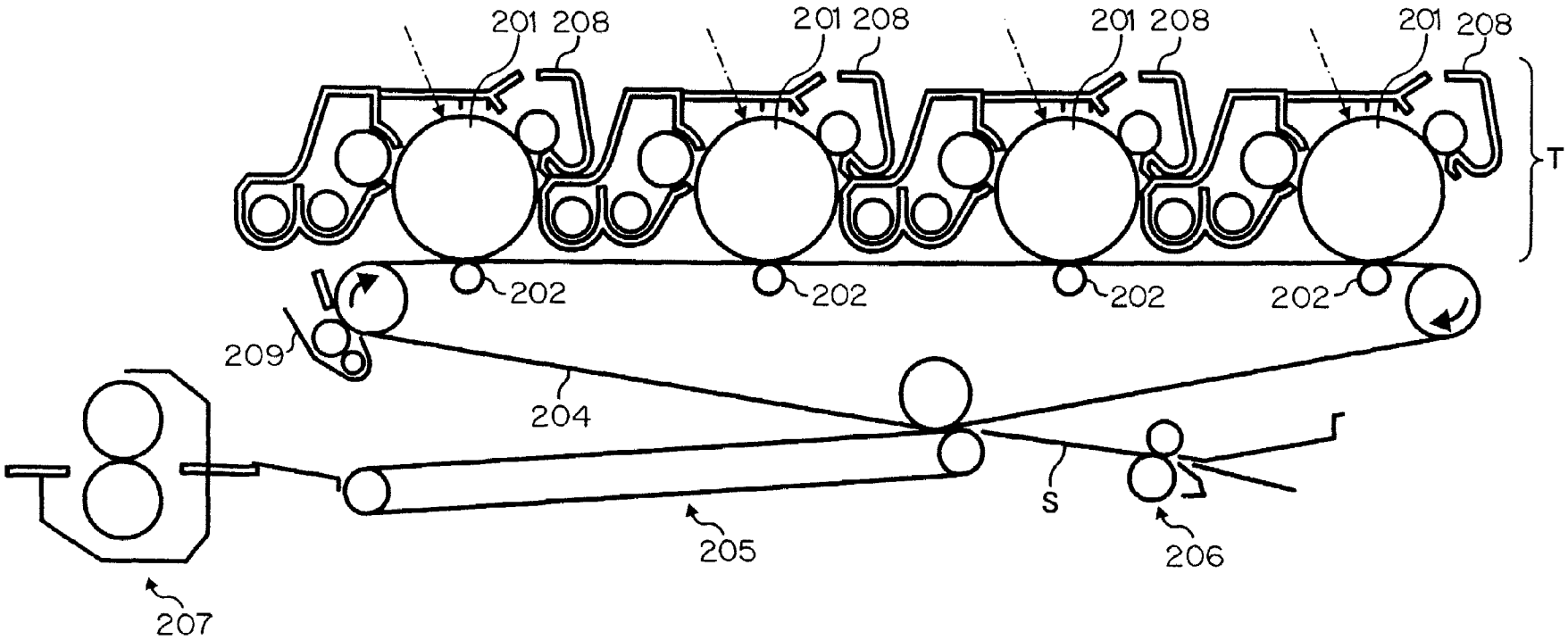
FIG. 8 is a schematic view illustrating another embodiment of a tandem full-color image forming apparatus of the present invention, using an intermediate transferer.

FIG. 7 is a schematic view illustrating an embodiment of a tandem full-color image forming apparatus of the present invention. The tandem-type electrophotographic image forming apparatus includes an apparatus using a direct transfer method of sequentially transferring an image on each photoreceptor 201 with a transferer 202 onto a sheet S fed by a sheet feeding belt 203 as shown in FIG. 7, and an apparatus using an indirect transfer method of sequentially transferring an image on each photoreceptor 201 with a first transferer 202 onto an intermediate transferer 204 and transferring the image thereon onto a sheet S with a second transferer 205 as shown in FIG. 8. The second transferer 205 has the shape of a belt, and may have the shape of a roller.

The direct transfer method has a disadvantage of being large toward a sheet feeding direction because a paper feeder 206 is located upstream of a tandem-type image forming apparatus T having photoreceptors 201 in a line, and a fixer 207 downstream thereof. To the contrary, the indirect method can be downsized because of being able to freely locate the second transferer 205, and can locate a paper feeder 206 and a fixer 207 together with a tandem-type image forming apparatus T.

To avoid being large toward a sheet feeding direction, the former method locates the fixer 207 close to the tandem-type image forming apparatus T. Therefore, the sheet S cannot flexibly enter the fixer 207, and an impact thereof to the fixer 207 when entering the fixer 207 and a difference of feeding speed of the sheet S between when passing through the fixer 207 and when fed by a feeding belt tend to affect an image formation in the upstream. To the contrary, the latter method can flexibly locate the fixer 207, and therefore the fixer 207 scarcely affects the image formation.

Therefore, recently, the tandem-type electrophotographic image forming apparatus using an indirect transfer method is widely used. FIG. 8 is a schematic view illustrating another embodiment of the tandem full-color image forming apparatus of the present invention, using the intermediate transferer 204.

In this type of full-color electrophotographic image forming apparatus, as shown in FIG. 8, a photoreceptor cleaner 208 removes a residual toner on the photoreceptor 201 to clean the surface thereof after a first transfer and ready for another image formation. In addition, an intermediate transferer cleaner 209 removes a residual toner on an intermediate transferer 204 to clean the surface thereof after second transfer and ready for another image formation.

Figure 9A:
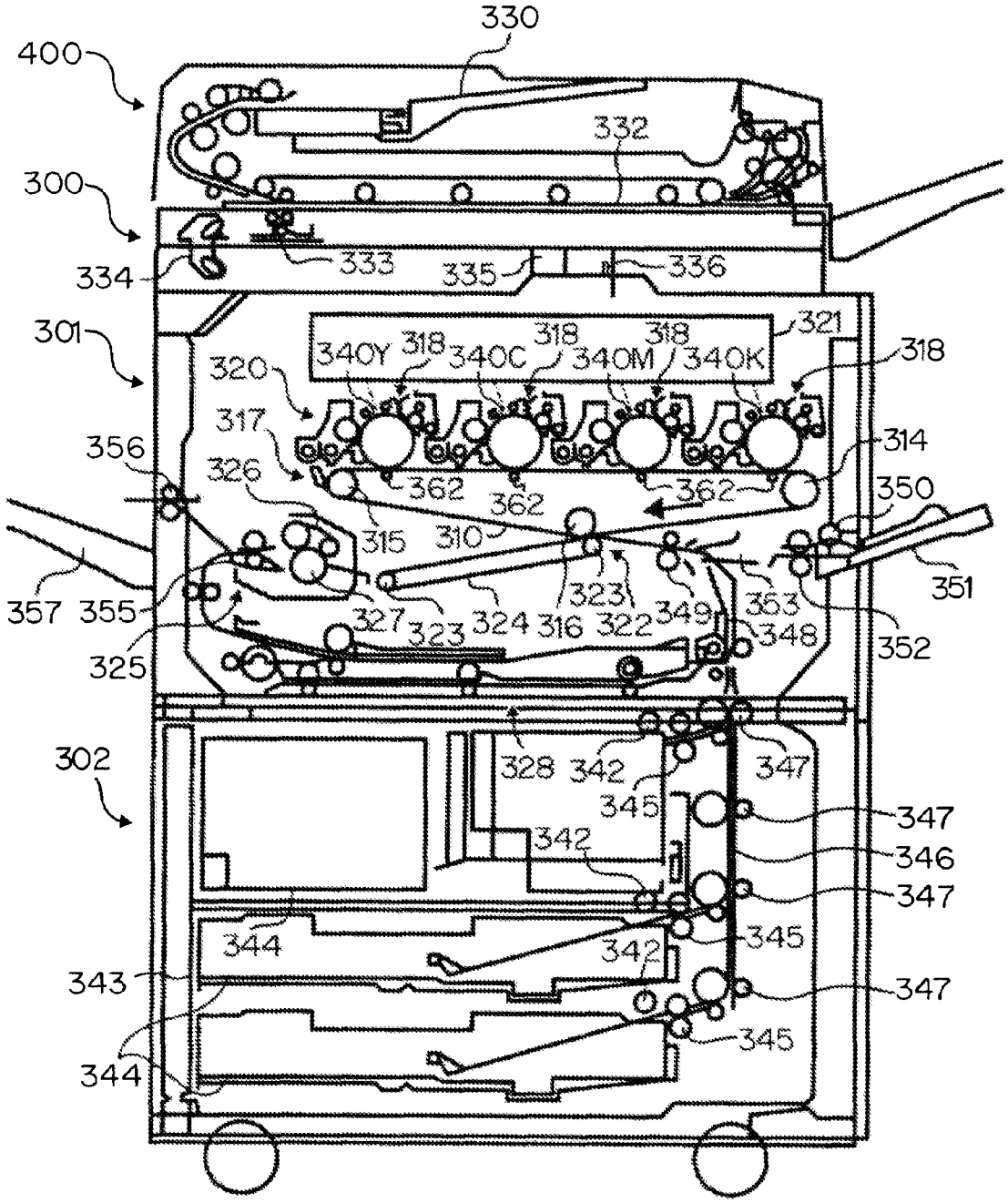
FIGS. 9A and 9B are schematic views illustrating a further embodiment of a tandem full-color image forming apparatus and its image developer of the present invention respectively, using an indirect transfer method.
Figure 9B:
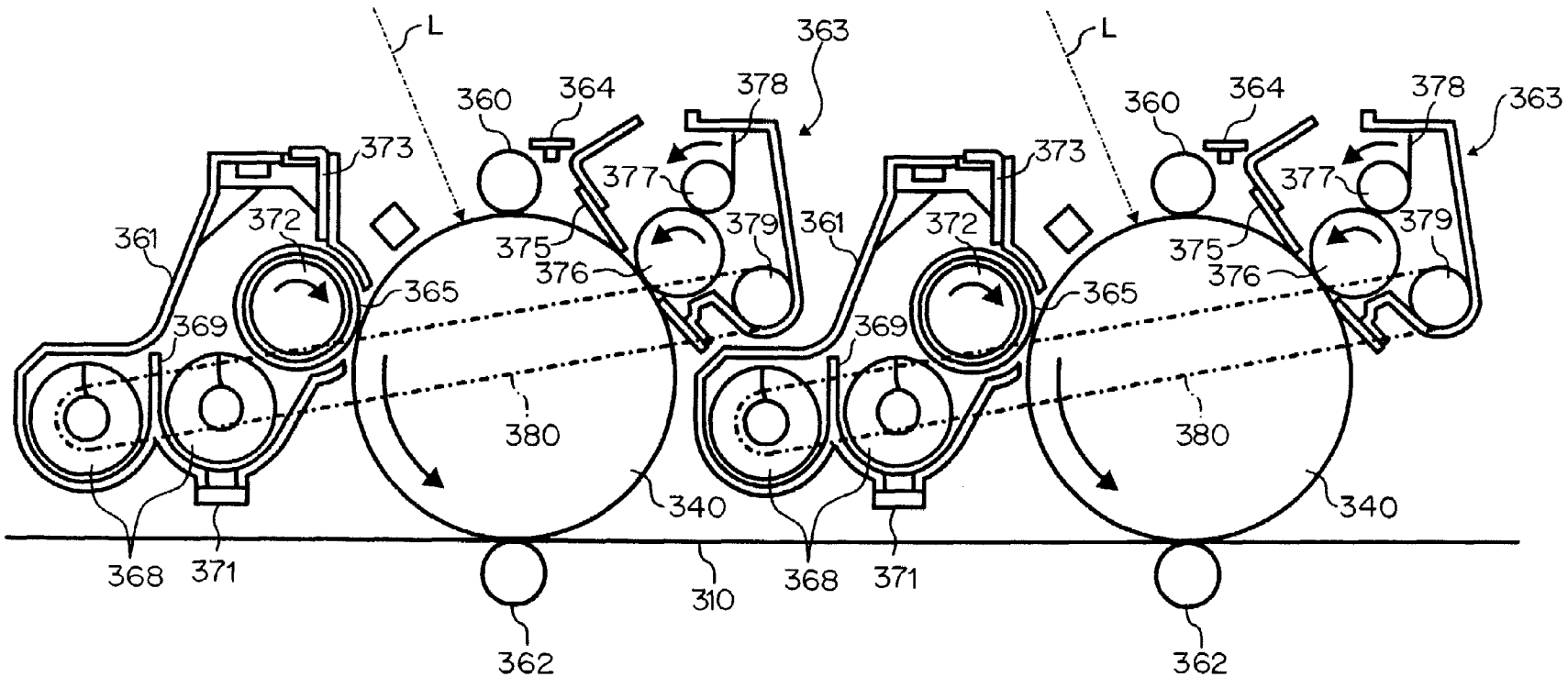

FIGS. 9A and 9B are schematic views illustrating a further embodiment of the tandem full-color image forming apparatus and its image developer of the present invention respectively, using an indirect transfer method. Numeral 301 is a copier, 302 is a paper feeding table, 300 is a scanner on the copier 301 and 400 is an automatic document feeder (ADF) on the scanner 300. The copier 301 includes an intermediate transferer 310 having the shape of an endless belt.

As shown in FIG. 9A, the intermediate transferer 310 is suspended by three suspension rollers 314, 315 and 316 and rotatable in a clockwise direction.

On the left of the suspension roller 315, an intermediate transferer cleaner 317 is located to remove a residual toner on an intermediate transferer 310 after an image is transferred.

Above the intermediate transferer 310, four image forming units 318 for yellow, cyan, magenta and black colors are located in a line from left to right along a transport direction of the intermediate transferer 310 to form a tandem image forming apparatus 320.

Above the tandem image forming apparatus 320, an image developer 321 is located as shown in FIG. 9B. On the opposite side of the tandem image forming apparatus 320 across the intermediate transferer 310, a second transferer 322 is located. The second transferer 322 includes an endless second transfer belt 324 and two rollers 323 suspending the endless second transfer belt 324, and is pressed against the suspension roller 316 across the intermediate transferer 310 and transfers an image thereon onto a sheet.

Beside the second transferer 322, a fixer 325 fixing a transferred image on the sheet is located. The fixer 325 includes an endless belt 326 and a pressure roller 327 pressed against the belt 326.

The second transferer 322 also includes a function of transporting the sheet onto which an image is transferred on to the fixer 325. As the second transferer 322, a transfer roller and a non-contact charger may be used. However, they cannot readily perform the function of transporting the sheet.

In FIG. 9A, below the second transferer 322 and the fixer 325, a sheet reverser 328 for reversing the sheet to form an image on both sides thereof is located in parallel with the tandem image forming apparatus 320.

An original is set on a table 330 of the ADF 400 to make a copy, or on a contact glass 332 of the scanner 300 and pressed with the ADF 400.

When a start switch (not shown) is put on, a first scanner 333 and a second scanner 334 scans the original after the original set on the table 330 of the ADF 400 is fed onto the contact glass 332 of the scanner 300, or immediately when the original set thereon. The first scanner 333 emits light to the original and reflects reflected light therefrom to the second scanner 334. The second scanner further reflects the reflected light to a reading sensor 336 through an imaging lens 335 to read the original.

When a start switch (not shown) is put on, a drive motor (not shown) rotates one of the suspension rollers 314, 315 and 316 such that the other two rollers are driven to rotate, in order to rotate the intermediate transferer 310. At the same time, each of the image forming units 318 rotates the photoreceptor 340Y, 340C, 340M or 340K (also identified generically in FIG. 9B as 340) and forms a single-colored image, i.e., a black image, a yellow image, a magenta image and cyan image on each photoreceptor 340Y, 340C, 340M or 340K based on the light beams "L" (FIG. 9B) incident on the photoreceptors. The single-colored images are sequentially transferred onto the intermediate transferer 310 to form a full-color image thereon.

On the other hand, when the start switch (not shown) is put on, one of paper feeding rollers 342 of paper feeding table 302 is selectively rotated to take a sheet out of one of multiple-stage paper cassettes 344 in a paper bank 343. A separation roller 345 separates sheets one by one and feed the sheet into a paper feeding route 346, and a feeding roller 347 feeds the sheet into a paper feeding route 348 of the copier 301 to be stopped against a registration roller 349.

Alternatively, a paper feeding roller 350 is rotated to take a sheet out of a manual feeding tray 351, and a separation roller 352 separates sheets one by one and feed the sheet into a paper feeding route 353 to be stopped against the registration roller 349.

Then, in timing with a synthesized full-color image on the intermediate transferer 310, the registration roller 349 is rotated to feed the sheet between the intermediate transferer 310 and the second transferer 322, and the second transferer transfers the full-color image onto the sheet.

The sheet the full-color image is transferred thereon is fed by the second transferer 322 to the fixer 325. The fixer 325 fixes the image thereon upon application of heat and pressure, and the sheet is discharged by a discharge roller 356 onto a catch tray 357 through a switch-over click 355. Alternatively, the switch-over click 355 feeds the sheet into the sheet reverser 328 reversing the sheet to a transfer position again to form an image on the backside of the sheet, and then the sheet is discharged by the discharge roller 356 onto the catch tray 357.

On the other hand, the intermediate transferer 310 after transferring an image is cleaned by the intermediate transferer cleaner 317 to remove a residual toner thereon after the image is transferred, and ready for another image formation by the tandem image forming apparatus 320.

The registration roller 349 is typically grounded, and a bias may be applied thereto to remove paper dust from the sheet. In the tandem image forming apparatus 320, each of the image forming units 318 includes, as shown in FIG. 9B, a charger 360, an image developer 361, a first transferer 362, a photoreceptor cleaner 363 and a discharger 364 around the drum-shaped photoreceptor 340. Numeral 365 represents a developer present on a developing sleeve 372, 368 represents an agitation paddle, 369 represents a division plate, 371 represents a toner concentration sensor, 373 represents a doctor blade, 375 represents a cleaning blade, 376 represents a cleaning brush, 377 represents a cleaning roller, 378 represents a cleaning blade, 379 represents a toner discharging auger, and 380 represents a drive device.

Figure 10:
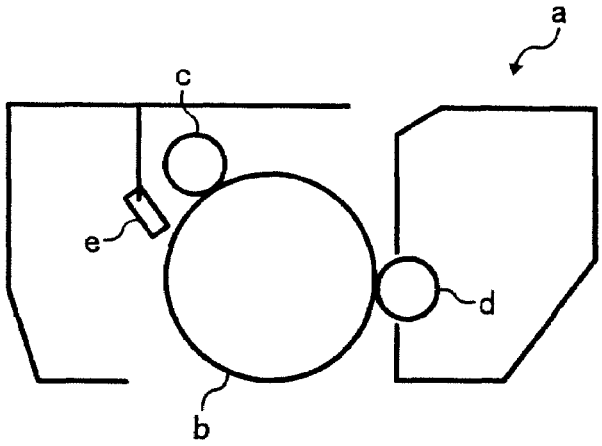
FIG. 10 is a schematic view illustrating a process cartridge of the present invention.

FIG. 10 is a schematic view illustrating a process cartridge of the present invention, wherein (a) is a whole process cartridge, (b) is a photoreceptor, (c) is a charger, (d) is an image developer and (e) is a cleaner.

In the present invention, at least (b) and (d) are combined in a body as a process cartridge detachable from an image forming apparatus such as a copier and a printer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The image developer 1 in FIG. 1 was used in an image forming apparatus in the present invention under the following conditions:

Linear speed: 175 mm/sec
Diameter of the photoreceptor: 30 mm
Sleeve/Photoreceptor linear speed ratio: 1.5
Gap between the photoreceptor and the sleeve: 0.4 mm
Gap between the developing roller and the doctor blade: 0.65 mm
Pumpage rate of developer: 60 (mg/cm$^2$)
Roller diameter: 18 mm
Main pole angle: 0°
Magnetic flux density of the main pole: 100 mT
Doctor-opposing magnetic flux density: 70 mT
Potential when charged: −450 V
Potential after irradiated: −60 V
Developing DC bias: −300 V
Developing AC bias:
Rectangular wave
Frequency: 2.75 kHz
Duty: 50%
Peak to peak voltage: 900 V The main pole angle is an angle of the main pole (P1 in FIG. 1, facing the photoreceptor, where an ear tip of the magnetic developer erects most toward the surface thereof) toward a line between the centers of the photoreceptor and the developing sleeve. An aluminum extrusion is cut to have a V-groove to form the developing sleeve. One hundred and thirty rectangular V-grooves having a depth of 65 μm are formed thereon. A regulator regulating an amount of the developer is formed of a material having stiffness and magnetism. The regulator can be formed of not only a metal such as iron and stainless, but also a resin including a magnetic particulate material such as ferrite and magnetite. In addition, the regulator need not always be formed of a magnetic material, and another member such as a metallic plate, formed of a magnetic material, can directly or indirectly be fixed on the regulator.

100 parts of a ferrite carrier coated with a silicone resin, having an average particle diameter of 35 μm, and 7 parts of each color toner were uniformly mixed in a TURBULA MIXER to form a two-component developer.

The following materials were dispersed by a homomixer for 15 minutes to prepare a silicone-coating liquid solution.

| | |
|---|---|
| Silicone resin solution<br>having a solid content of 23% by weight<br>SR2410 from Dow Corning Toray Silicone Co., Ltd. | 167 |
| Amino silane<br>having a solid content of 100% by weight<br>SH6020 from Dow Corning Toray Silicone Co., Ltd. | 0.66 |
| Nonconductive particulate material<br>spherical aluminum having an average particle diameter of 0.35 μm | 31 |
| Toluene | 300 |

The silicone-coating liquid solution was coated and dried on a calcined Mn ferrite powder having a weight-average particle diameter of 35 μm by SPIRA COTA, wherein the temperature was 40° C., from OKADA SEIKO CO., LTD. such that the coated film has a thickness of 0.5 μm to prepare a carrier. The resultant carrier was calcined in an electric oven at 300° C. for 1 hour, and after cooled, the carrier was sieved through openings of 63 μm to have alumina of 60% by weight, a volume resistivity of 14.1 Log(Ω·cm) and a magnetization of 68 A $m^2$/kg [first carrier].

The procedure for preparation of the first carrier was repeated to prepare a second carrier except for coating the silicone-coating liquid solution excluding the nonconductive particulate material on a calcined Mn ferrite powder having a weight-average particle diameter of 55 μm. The second carrier had the alumina of 0% by weight, a volume resistivity of 15.3 Log Ω·cm and a magnetization of 68 A $m^2$/kg.

The procedure for preparation of the first carrier was repeated to prepare a third carrier except for coating the silicone-coating liquid solution on a calcined Mn ferrite powder having a weight-average particle diameter of 65 μm. The third carrier had the alumina of 60% by weight, a volume resistivity of 14.2 Log Ω·cm and a magnetization of 68 A $m^2$/kg.

The average particle diameter of a carrier can be measured by SRA type of MICROTRAC particle size analyzer from NIKKISO CO., LTD., measuring a range of from 0.7 to 125 μm.

The thickness of a resin coated on a carrier is measured by forming a cross-section with a FIB (focused ion beam), and observing the cross-section with a TEM (transmission electron microscope), a STEM (scanning transmission electron microscope) to determine an average of the thickness.

0.15 g of a sample are filled in a cell having an inner diameter of 2.4 mm and a height of 8.5 mm, and the magnetization thereof is measured by VSM-P7-15 from TOEI INDUSTRY CO., LTD. in a magnetic field of 1,000 Oe.

100 g of a silica fine powder having a BET specific surface area of 300 $m^2$/g, prepared by a gas phase method were placed in a reactor tank, and 2.0 g of water were sprayed thereon while stirred in a nitrogen atmosphere. 10 g of hexamethyldisilazane were further sprayed thereon, and the silica fine powder sprayed therewith was heated at 150° C. while stirred for 1 hour and cooled. The silica fine powder cooled was pulverized with a jet mill to prepare a particulate silica to have an average primary particle diameter of 10 nm. The particulate silica was further classified by a dry classifier TC-40 II from Nisshin Engineering Inc. to remove aggregated particles having a particle diameter not less than 50 μm to prepare a first silica.

The procedure for preparation of the first silica was repeated to prepare a second silica except for not classifying the particulate silica.

Example 1

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 166 parts of methacrylate, 110 parts of butylacrylate and 1 part of persulfate ammonium were mixed in a reactor vessel including a stirrer and a thermometer, and the mixture was stirred for 30 minutes at 3,800 rpm to prepare a white emulsion therein. The white emulsion was heated to have a temperature of 75° C. and reacted for 3 hours. Further, 30 parts of an aqueous solution of persulfate ammonium having a concentration of 1% were added thereto and the mixture was reacted at 70° C. for 5 hrs to prepare an aqueous dispersion a first particulate dispersion liquid of a vinyl resin (a copolymer of a sodium salt of an adduct of styrene-methacrylate-butylacrylate-sulfuric ester with ethyleneoxide methacrylate). The first particulate dispersion liquid was measured by LA-920 to find a volume-average particle diameter thereof was 75 nm. A part of the first particulate dispersion liquid was dried to isolate a resin component therefrom. The resin component had a Tg of 60° C. and a weight-average molecular weight of 110,000.

990 parts of water, 83 parts of the first particulate dispersion liquid, 37 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid a first aqueous phase.

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe at a normal pressure and 230° C. for 7 hours. Further, after the mixture was depressurized by 10 to 15 mm Hg and reacted for 5 hours, 44 parts of trimellitic acid anhydride were added thereto and the mixture was reacted at a normal pressure and 180° C. for 3 hours to prepare a first low-molecular-weight polyester. The first low-molecular-weight polyester had a number-average molecular weight of 2,300, a weight-average molecular weight of 6,700, a Tg of 43° C. and an acid value of 25.

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe at a normal pressure and 230° C. for 7 hours. Further, after the mixture was depressurized to 10 to 15 mm Hg and reacted for 5 hours to prepare a first intermediate polyester. The first intermediate polyester had a number-average molecular weight of 2,200, a weight-average molecular weight of 9,700, a Tg of 54° C. and an acid value of 0.5 and a hydroxyl value of 52. Next, 410 parts of the first intermediate polyester, 89 parts of isophoronediisocyanate and 500 parts of ethyl acetate were reacted in a reactor vessel including a cooling pipe, a stirrer and a nitrogen inlet pipe for 5 hrs at 100° C. to prepare a first prepolymer. The first prepolymer included a free isocyanate in an amount of 1.53% by weight.

170 parts of isophoronediamine and 75 parts of methyl ethyl ketone were reacted at 50° C. for 4 hours and a half in a reaction vessel including a stirrer and a thermometer to prepare a first ketimine compound. The first ketimine compound had an amine value of 417.

600 parts of water, 1,200 parts of Pigment Blue 15:3 aqueous cake including a solid content of 50% by weight and 1,200 parts of a polyester resin were mixed by a HENSCHEL MIXER from Mitsui Mining Co., Ltd. After the mixture was kneaded by a two-roll mill having a surface temperature of 120° C. for 45 minutes, the mixture was extended by applying pressure, cooled and pulverized by a pulverizer to prepare a first master batch.

378 parts of the first low-molecular-weight polyester, 100 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hours, the mixture was cooled to have a temperature of 30° C. in an hour. Then, 500 parts of the first master batch and 500 parts of ethyl acetate were added to the mixture and mixed for 1 hour to prepare a first material solution.

1,324 parts of the first material solution were transferred into another vessel, and the carbon black and wax therein were dispersed by a beads mill (Ultra Visco Mill from IMECS CO., LTD.) for 3 passes under the following conditions: liquid feeding speed of 1 kg/hr; peripheral disc speed of 6 m/sec; and filling zirconia beads having diameter of 0.5 mm for 80% by volume.

Next, 1,324 parts of an ethyl acetate solution of the first low-molecular-weight polyester having a concentration of 65% were added to the first material solution and the mixture was stirred by the beads mill for 2 passes under the same conditions to prepare a first pigment and wax dispersion liquid. The first pigment and wax dispersion liquid had a solid content concentration of 50% when dispersed at 130° C. for 30 min.

749 parts of the first pigment and wax dispersion liquid, 115 parts of the first prepolymer and 2.9 parts of the first ketimine compound were mixed in a vessel by a TK-type homomixer from Tokushu Kika Kogyo Co., Ltd. at 5,000 rpm for 2 minutes. 1,200 parts of the first aqueous phase were added to the mixture and mixed by the TK-type homomixer at 13,000 rpm for 25 minutes to prepare a first emulsified slurry.

The first emulsified slurry was put in a vessel including a stirrer and a thermometer. After a solvent was removed from the emulsified slurry 1 at 30° C. for 8 hours, the slurry was aged at 45° C. for 7 hours to prepare a first dispersion slurry.

After the first dispersion slurry was filtered under reduced pressure, 100 parts of ion-exchange water were added to the filtered cake and mixed by the TK-type homomixer at 12,000 rpm for 10 minutes, and the mixture was filtered.

Further, 100 parts of an aqueous solution of 10% sodium hydrate were added to the filtered cake and mixed by the TK-type homomixer at 12,000 rpm for 30 minutes, and the mixture was filtered under reduced pressure.

Further, 100 parts of 10% hydrochloric acid were added to the filtered cake and mixed by the TK-type homomixer at 12,000 rpm for 10 minutes, and the mixture was filtered.

Further, 300 parts of ion-exchange water were added to the filtered cake and mixed by the TK-type homomixer at 12,000 rpm for 10 minutes, and the mixture was filtered. This operation was repeated again to prepare a first filtered cake.

The first filtered cake was dried by an air drier at 45° C. for 48 hours to prepare toner particles.

In a tank containing water medium wherein the following fluorine-containing compound (2) was dispersed in an amount of 1% by weight, the fluorine-containing compound (2) was mixed with the toner particles so as to adhere thereto in an amount of 0.1% by weight based on total weight thereof.

(2)

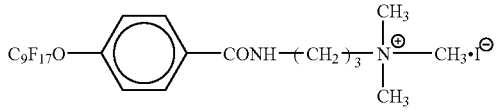

The toner particles were dried by an air drier at 45° C. for 48 hours, and further dried at 30° C. for 10 hours in a shelf, and sieved by a mesh having an opening of 75 μm to prepare a first toner particles.

100 parts of the first toner particles, 1.5 parts of silica 1 and 0.5 parts of hydrophobized titanium oxide having an average primary particle diameter of 13 nm were mixed by a HENSCHEL MIXER FM20C from Mitsui Mining Co., Ltd, at a peripheral speed of 30 m/sec for 120 seconds and paused for 60 seconds for 5 times, to prepare a toner.

7 parts of the toner and 100 parts of the first carrier were uniformly mixed with a TURBULA MIXER to prepare a charged developer. The properties of the toner and developer are shown in Table 1, and the evaluation results thereof are shown in Table 2.

Example 2

The procedure for preparation of the toner in Example 1 was repeated to prepare a toner except for mixing 100 parts of the first toner particles, 1.5 parts of silica 1 and 0.5 parts of hydrophobized titanium oxide having an average primary particle diameter of 13 nm with a HENSCHEL MIXER FM20C from Mitsui Mining Co., Ltd, at a peripheral speed of 23 m/sec for 30 seconds and paused for 60 seconds for 6 times. The properties of the toner and developer are shown in Table 1, and the evaluation results thereof are shown in Table 2.

Example 3

The procedure for preparation of the toner in Example 1 was repeated to prepare a toner except for mixing 100 parts of the first toner particles, 1.5 parts of silica 1 and 0.5 parts of hydrophobized titanium oxide having an average primary particle diameter of 13 nm with a HENSCHEL MIXER FM20C from Mitsui Mining Co., Ltd, at a peripheral speed of 35 m/sec for 120 seconds and paused for 60 seconds for 8 times. The properties of the toner and developer are shown in Table 1, and the evaluation results thereof are shown in Table 2.

Example 4

The procedure for preparation of the toner in Example 1 was repeated to prepare a toner except for changing the gap between the photoreceptor and the sleeve to 0.3 mm. The properties of the toner and developer are shown in Table 1, and the evaluation results thereof are shown in Table 2.

Example 5

The procedure for preparation of the toner in Example 1 was repeated to prepare a toner except for changing the gap between the photoreceptor and the sleeve to 0.6 mm. The properties of the toner and developer are shown in Table 1, and the evaluation results thereof are shown in Table 2.

Example 6

The procedure for preparation of the toner in Example 1 was repeated to prepare a toner except for dispersing silica having a primary particle diameter of 10 nm, which was prepared by a combustion method and hydrophobized with hexamethyldisilazane, and titanium oxide each in an amount of 1.2% by weight in a tank containing water medium wherein the following fluorine-containing compound (2) was dispersed in an amount of 1% by weight, such that the fluorine-containing compound (2), the silica and the titanium oxide were mixed with the toner particles and finally adhered thereto in an amount of 0.1%, 1.5% and 1.0% by weight respectively based on total weight thereof.

(2)

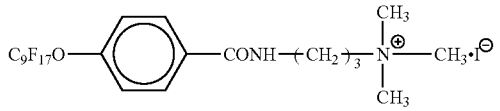

Example 7

The procedure for preparation of the toner in Example 1 was repeated to prepare a toner except for mixing 100 parts of the first toner particles, 1.5 parts of silica 1, 0.5 parts of hydrophobized titanium oxide having an average primary particle diameter of 13 nm and 0.15 parts of zinc stearate. The properties of the toner and developer are shown in Table 1, and the evaluation results thereof are shown in Table 2.

Example 8

The procedure for preparation of the toner in Example 1 was repeated to prepare a toner except that 749 parts of the first pigment and wax dispersion liquid, 115 parts of the first prepolymer and 2.9 parts of the first ketimine compound were mixed in a vessel by a TK-type homomixer from Tokushu Kika Kogyo Co., Ltd. at 5,000 rpm for 2 minutes, 1,200 parts of the first aqueous phase were added to the mixture and mixed by the TK-type homomixer at 12,000 rpm for 20 minutes to prepare a first emulsified slurry, the first emulsified slurry was put in a vessel including a stirrer and a thermometer, and that after a solvent was removed from the first emulsified slurry at 30° C. for 5 hours, the slurry was aged at 45° C. for 4 hours to prepare a first dispersion slurry.

The properties of the toner and developer are shown in Table 1, and the evaluation results thereof are shown in Table 2.

Example 9

The procedure for preparation of the toner in Example 1 was repeated to prepare a toner except that 630 parts of the first pigment and wax dispersion liquid, 120 parts of the first prepolymer and 3.1 parts of the first ketimine compound were mixed in a vessel by a TK-type homomixer from Tokushu Kika Kogyo Co., Ltd. at 5,000 rpm for 2 minutes, 1,200 parts of the first aqueous phase were added to the mixture and mixed by the TK-type homomixer at 10,000 rpm for 30 minutes to prepare a first emulsified slurry, the first emulsified slurry was put in a vessel including a stirrer and a thermometer, and that after a solvent was removed from the first emulsified slurry at 30° C. for 10 hours, the slurry was aged at 45° C. for 24 hours to prepare a first dispersion slurry.

The properties of the toner and developer are shown in Table 1, and the evaluation results thereof are shown in Table 2.

Comparative Example 1

The procedure for preparation of the toner in Example 1 was repeated to prepare a toner except for uniformly mixing 7 parts of the toner and 100 parts of the second carrier with a TURBULA MIXER to prepare a charged developer. The properties of the toner and developer are shown in Table 1, and the evaluation results thereof are shown in Table 2.

Comparative Example 2

The procedure for preparation of the toner in Example 1 was repeated to prepare a toner except for uniformly mixing 7 parts of the toner and 100 parts of the first carrier with a TURBULA MIXER to prepare a charged developer. The properties of the toner and developer are shown in Table 1, and the evaluation results thereof are shown in Table 2.

(Evaluation Items)

1) Spent Resistance 100,000 images each having an image area by 20% were produced so as to have an image density of 1.4±0.2 mg/cm$^2$ (an amount of toner attached on the image). The charge quantity of the developer before and after 100,000 images were produced were measured by a blowoff method to see the loss thereof after 100,000 images were produced.

0 to 30%: ○

30 to 50%: Δ

50% or more: X

2) Pumpage of Developer 100,000 solid images were produced so as to have an image density of 1.4±0.2 mg/cm$^2$ (an amount of toner attached on the image) to visually observe uniformity of the solid images.

Good: ○

Slightly nonuniform, but usable: Δ

Apparently nonuniform, and unusable: X

3) Particle Diameter

The volume-average particle diameter and the number-average particle diameter of the toner were measured by a Coulter counter TA-II from Beckman Coulter, Inc., at an aperture diameter of 100 μm.

4) Average Circularity

The circularity of the toner was measured by a flow-type particle image analyzer FPIA-1000 from SYSMEX CORPORATION. A specific measuring method includes adding 0.3 ml of a surfactant, preferably an alkylbenzenesulfonic acid, as a dispersant in 120 ml of water from which impure solid materials are previously removed; adding 0.2 g of the toner in the mixture; dispersing the mixture including the toner with an ultrasonic disperser for 2 minutes to prepare a dispersion liquid having a concentration of 5,000 pieces/μl; and measuring the toner shape and distribution with the above-mentioned measurer.

5) Image Granularity and Sharpness

Mono-color images were produced and visually observed to evaluate the image granularity and sharpness. ◎ was as good as an offset printing, ○ was slightly worse than the offset printing, Δ was considerably worse than the offset printing and X was very poor.

6) Foggy Images

In an environment where a temperature was 10° C. and a humidity was 15%, the toner and the carrier were idly stirred for 1 hour and deteriorated in the image developer without producing images. This gives an extremely a large stress to the toner.

Then, 100 images each having an image area of 5% were continuously produced to visually (with a loupe) observe the background of the last image whether contaminated with the toner. ◎ means that no toner contamination was observed, ○ means a slight contamination without problems, Δ means a contamination was observed and X means an unacceptable contamination with serious problems.

7) Toner Scattering

After 100,000 images each having an image area of 5% were continuously produced, the toner contamination in the image forming apparatus was visually observed. ◎ means that no toner contamination was observed, ○ means a slight contamination without problems, Δ means a contamination was observed and X means an unacceptable contamination with serious problems.

8) Environmental (Blocking) Resistance 10 g of the toner was put in a glass container having a capacity of 20 ml and the glass container was tapped for 100 times. Then, after the glass container was left in a constant temperature bath having a temperature of 55° C. and a humidity of 80% for 24 hours, a penetration of the toner was measured by a penetrometer. A penetration thereof left in an environment of low temperature and low humidity was also measured. A smaller penetration in either of the high temperature and humidity environment and the low temperature and humidity environment was used to evaluate. The larger the better. ◎ was not less than 20 mm, ○ was not less than 15 mm and less than 20 mm, Δ was not less than 10 mm and less than 15 mm and X was less than 10 mm.

9) Transferability

The developer was idly stirred for 60 minutes and stressed in the image developer without producing images. After a toner image having a volume of 0.4 mg/cm$^2$, which was developed on the photoreceptor, was transferred onto a paper Type 6200 from Ricoh Company, Ltd. with a transfer current of 15 μA, an untransferred toner remaining on the photoreceptor is taped with SCOTCH TAPE from Sumitomo 3M Ltd. and transferred onto a white paper. The image density thereof was measured by X-Rite from X-Rite, Inc. When a difference of the density between the white paper the residual toner was transferred onto and a blank space thereof was less than 0.005, the transferability was determined as ◎. From 0.005 to 0.015 was ○, from 0.016 to 0.02 was Δ and greater than 0.02 was X.

10) SF-1 and SF-2

SF-1 and SF-2 (shape factors) were measured by photographing 300 particles of the toner with an FE-SEM (S-4200) from Hitachi, Ltd. and analyzing the photographed image with an image analyzer Luzex AP from NIRECO Corp through an interface.

TABLE 1

| | 25FRI | Gp | Particle diameter of carrier | Whether carrier includes nonconductive participate material | Dv | Dn | Dv/Dn |
|---|---|---|---|---|---|---|---|
| Ex. 1 | 1.4 | 0.4 | 35 | Yes | 5.6 | 5.2 | 1.08 |
| Ex. 2 | 1.5 | 0.4 | 35 | Yes | 5.6 | 5.2 | 1.08 |
| Ex. 3 | 1.3 | 0.4 | 35 | Yes | 5.6 | 5.2 | 1.08 |
| Ex. 4 | 1.7 | 0.3 | 35 | Yes | 5.6 | 5.2 | 1.08 |
| Ex. 5 | 1.2 | 0.6 | 35 | Yes | 5.6 | 5.2 | 1.08 |
| Ex. 6 | 1.3 | 0.4 | 35 | Yes | 5.6 | 5.2 | 1.08 |
| Ex. 7 | 1.6 | 0.4 | 35 | Yes | 5.6 | 5.2 | 1.08 |
| Ex. 8 | 1.5 | 0.4 | 35 | Yes | 6.1 | 5.4 | 1.13 |
| Ex. 9 | 1.5 | 0.4 | 35 | Yes | 5.7 | 5.2 | 1.10 |
| Com. Ex. 1 | 2.1 | 0.4 | 35 | No | 5.6 | 5.2 | 1.08 |
| Com. Ex. 2 | 2.3 | 0.4 | 65 | Yes | 5.6 | 5.2 | 1.08 |

| | Shape of Toner | | | | |
|---|---|---|---|---|---|
| | Circularity | SF-1 | SF-2 | $r_2/r_1$ | $r_3/r_2$ |
| Ex. 1 | 0.97 | 130 | 121 | 0.9 | 0.9 |
| Ex. 2 | 0.97 | 130 | 121 | 0.9 | 0.9 |
| Ex. 3 | 0.97 | 130 | 121 | 0.9 | 0.9 |
| Ex. 4 | 0.97 | 130 | 121 | 0.9 | 0.9 |
| Ex. 5 | 0.97 | 130 | 121 | 0.9 | 0.9 |
| Ex. 6 | 0.97 | 130 | 121 | 0.9 | 0.9 |
| Ex. 7 | 0.97 | 130 | 121 | 0.9 | 0.9 |
| Ex. 8 | 0.94 | 132 | 126 | 0.9 | 0.9 |
| Ex. 9 | 0.98 | 140 | 132 | 0.8 | 0.7 |
| Com. Ex. 1 | 0.97 | 130 | 121 | 0.9 | 0.9 |
| Com. Ex. 2 | 0.97 | 130 | 121 | 0.9 | 0.9 |

TABLE 2

| | Spent resistance | Pumpage of developer | Image granularity and sharpness | Foggy images | Toner scattering | Environmental resistance | Transferability |
|---|---|---|---|---|---|---|---|
| Ex. 1 | ○ | ○ | ○ | ○ | ○ | ○ | ○ |
| Ex. 2 | Δ | ○ | ○ | ○ | ○ | ○ | Δ |
| Ex. 3 | ○ | ○ | ○ | ◎ | ○ | Δ | ○ |
| Ex. 4 | Δ | ○ | ○ | ◎ | ◎ | ○ | ○ |
| Ex. 5 | ○ | Δ | Δ | Δ | Δ | ○ | Δ |
| Ex. 6 | ○ | ○ | ○ | ◎ | ○ | ○ | Δ |
| Ex. 7 | ○ | Δ | ○ | ○ | ○ | ◎ | ◎ |
| Ex. 8 | ○ | ○ | Δ | Δ | ○ | ○ | ○ |

TABLE 2-continued

| | Spent resistance | Pumpage of developer | Image granularity and sharpness | Foggy images | Toner scattering | Environmental resistance | Transferability |
|---|---|---|---|---|---|---|---|
| Ex. 9 | ○ | ○ | Δ | ○ | ○ | ○ | Δ |
| Com. Ex. 1 | X | X | Δ | Δ | Δ | Δ | Δ |
| Com. Ex. 2 | X | X | X | X | X | X | X |

This application claims priority and contains subject matter related to Japanese Patent Application No. 2005-354322 filed on Dec. 8, 2005, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

an image bearer configured to bear an electrostatic latent image on the surface thereof;

a magnetic field generator configured to generate a magnetic field;

a developer bearer comprising a non-magnetic developing sleeve, configured to rotate and bear at least one two-component developer comprising a magnetic carrier and a toner;

a developing electric field generator configured to generate a developing electric field between the image bearer and the developer bearer; and an image developer configured to agitate the magnetic carrier and the toner to form two-component developer and develop the electrostatic latent image therewith in the developing electric field to form a toner image, wherein the two-component developer at least has a current speed index (25FRI) of from 0 to 2.0, which is determined by the following formula:

$$25FRI=(\text{total energy at 10 mm/s}/\text{total energy at 100 mm/s})$$

wherein the total energy is an integral sum of a rotary torque and a vertical load when a blade of a powder fluidity analyzer spirally rotates at 10 mm/s and 100 mm/s, respectively, in the developer having a volume of 25 ml after idly agitated in the image developer for 10 minutes.

2. The image forming apparatus of claim 1, wherein the current speed index is from 1.2 to 2.0.

3. The image forming apparatus of claim 1, wherein the image bearer and the non-magnetic developing sleeve have a gap of from 0.01 to 0.7 mm therebetween.

4. The image forming apparatus of claim 1, wherein the carrier has a weight-average particle diameter of from 15 to 45 μm.

5. The image forming apparatus of claim 1, wherein the carrier comprises:

a core material; and a resin-coated layer located overlying the core material, wherein the resin-coated layer comprises a nonconductive particulate material.

6. The image forming apparatus of claim 5, wherein the nonconductive particulate material is one or more nonconductive particulate materials selected from the group consisting of aluminum oxide, titanium dioxide, zinc oxide, silicon dioxide, barium sulfate and zirconium oxide, each having a weight-average particle diameter of from 5 to 1,000 nm.

7. The image forming apparatus of claim 1, wherein the toner comprises an external additive selected from the group consisting of metal oxides, metal nitrides and metal carbides.

8. The image forming apparatus of claim 7, wherein the external additive is titanium oxide having a number-average primary particle diameter of from 5 to 40 nm.

9. The image forming apparatus of 7, wherein the external additive is dry-mixed with a mixing medium.

10. The image forming apparatus of claim 7, wherein the external additive is wet-mixed.

11. The image forming apparatus of claim 1, wherein the toner comprises a release agent which is a wax having a hydrocarbon straight chain.

12. The image forming apparatus of claim 1, wherein the toner comprises a fatty acid metal salt.

13. The image forming apparatus of claim 1, wherein the toner is colored.

14. The image forming apparatus of claim 1, wherein the toner has an average circularity not less than 0.94 and less than 1.00.

15. The image forming apparatus of claim 1, wherein the toner has a volume-average particle diameter (Dv) of from 2.0 to 8.0 μm and a ratio (Dv/Dn) of the volume average particle diameter (Dv) to a number-average particle diameter (Dn) of from 1.00 to 1.40.

16. The image forming apparatus of claim 1, wherein the toner has shape factors SF-1 and SF-2 each of from 100 to 180.

17. The image forming apparatus of claim 1, wherein the toner satisfies the following relationship:

$$0.5 \leqq (r_2/r_1) \leqq 1.0 \text{ and } 0.7 \leqq (r_3/r_2) \leqq 1.0$$

wherein $r_1$, $r_2$ and $r_3$ represent an average major axis particle diameter, an average minor axis particle diameter and an average thickness of particles of the toner, respectively, and wherein $r_3 \leqq r_2 \leqq r_1$.

18. The image forming apparatus of claim 1, wherein the toner is prepared by a method comprising:

dispersing toner constituents comprising a compound having an active hydrogen atom, a polymer having a site reactable with the active hydrogen atom, a polyester resin, a colorant and a release agent in an organic solvent to prepare a toner constituents solution; and dispersing the toner constituents solution in an aqueous medium under the presence of a particulate resin such that the toner constituents are subject to at least one of a crosslinking reaction and an elongation reaction.

19. The image forming apparatus of claim 1, further comprising:

a charger configured to uniformly charge a surface of the image bearer;

an irradiator configured to irradiate the surface of the image bearer based on image data to write the electrostatic latent image thereon;

a transferer configured to transfer the toner image onto a receiving material; and a fixer configured to fix the toner image on the receiving material.

20. A process cartridge, comprising the image bearer; and the image developer, wherein the process cartridge is detachable from the image forming apparatus of claim 1.

* * * * *